US007055216B2

(12) United States Patent
Seidler

(10) Patent No.: US 7,055,216 B2
(45) Date of Patent: Jun. 6, 2006

(54) MAGNETIC HINGE

(75) Inventor: David Seidler, Forest Hills, NY (US)

(73) Assignee: Concept Workshop Worldwide LLC, New York, NY (US)

( * ) Notice: Subject to any disclaimer, the term of this patent is extended or adjusted under 35 U.S.C. 154(b) by 0 days.

(21) Appl. No.: 10/744,340

(22) Filed: Dec. 23, 2003

(65) Prior Publication Data

US 2004/0134030 A1 Jul. 15, 2004

Related U.S. Application Data

(63) Continuation-in-part of application No. 10/093,919, filed on Mar. 7, 2002, now abandoned.

(51) Int. Cl.
*A45D 33/00* (2006.01)

(52) U.S. Cl. ..... 16/320

(58) Field of Classification Search ..... 16/320, 16/254, 260, 261; 403/127, 340, DIG. 1; 63/9, 10, 18, 19, 900; 24/303; 220/230, 220/810; 132/295, 300; 43/54.1, 41
See application file for complete search history.

(56) References Cited

U.S. PATENT DOCUMENTS 2,327,513 A * 8/1943 Esterow ..... 132/301
4,231,137 A * 11/1980 Fujimoto ..... 24/303
4,513,974 A * 4/1985 Lin ..... 273/239
5,135,012 A * 8/1992 Kamen et al. ..... 132/294
5,572,887 A * 11/1996 Geswelli ..... 63/3
5,632,394 A * 5/1997 Mecca et al. ..... 220/824
6,070,749 A * 6/2000 Joulia ..... 220/4.22
6,109,818 A * 8/2000 Engel ..... 403/322.2
6,245,006 B1 * 6/2001 Olson ..... 600/15
6,505,385 B1 * 1/2003 Grunberger ..... 24/303
6,598,272 B1 * 7/2003 Nire ..... 24/303
6,619,297 B1 * 9/2003 Sheng ..... 132/295
6,715,315 B1 * 4/2004 Hartgrove ..... 63/29.2
6,812,817 B1 * 11/2004 Thibideau ..... 335/285
6,831,541 B1 * 12/2004 Seidler ..... 335/306

* cited by examiner

*Primary Examiner*—Robert J. Sandy
*Assistant Examiner*—Andre' L. Jackson
(74) *Attorney, Agent, or Firm*—Amster, Rothstein & Ebenstein LLP

(57) ABSTRACT

A magnetic hinge defining a hinge axis includes first and second hinge plates of non-magnetic material and first and second magnets disposed therein, respectively, for movement therewith. The plates are generally parallel and independently pivotable about the hinge axis between a closed orientation, wherein the plates are essentially superposed, and an open orientation, wherein the plates are essentially not superposed. The first and second magnets are essentially superposed, generally coaxial with the hinge axis, and in the same magnetic orientation.

27 Claims, 30 Drawing Sheets

FIG. 6
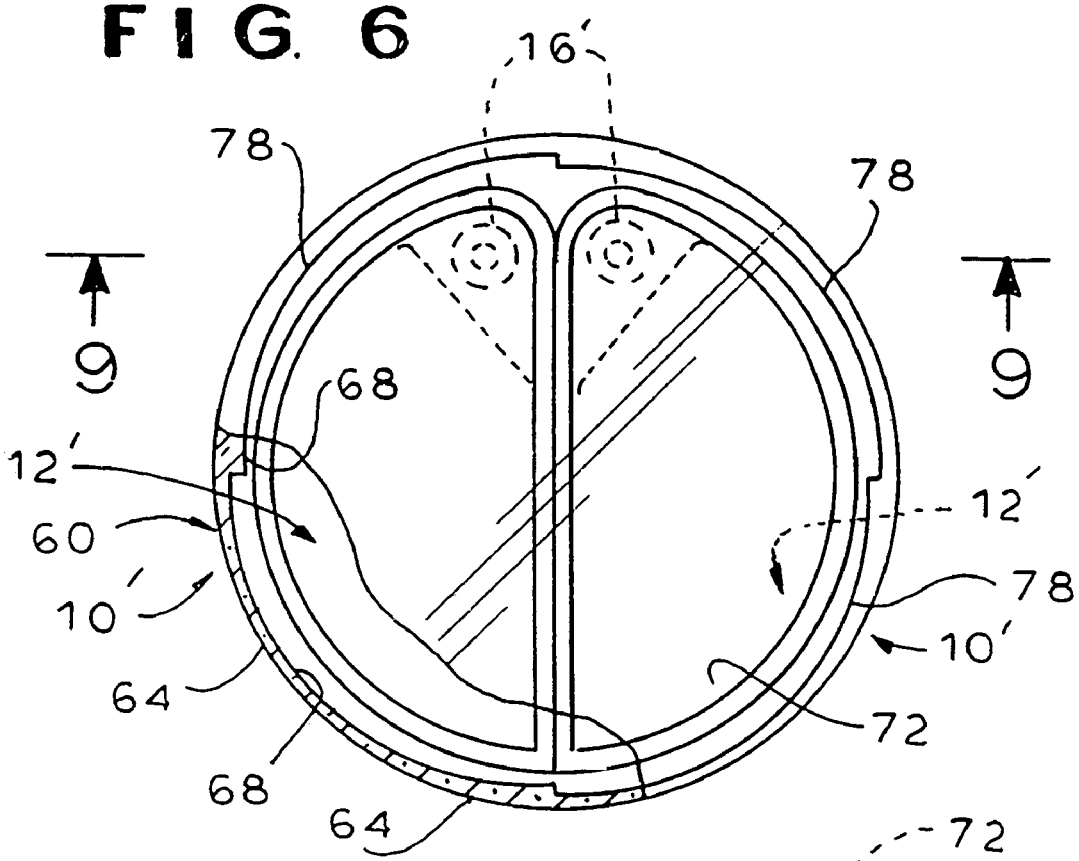
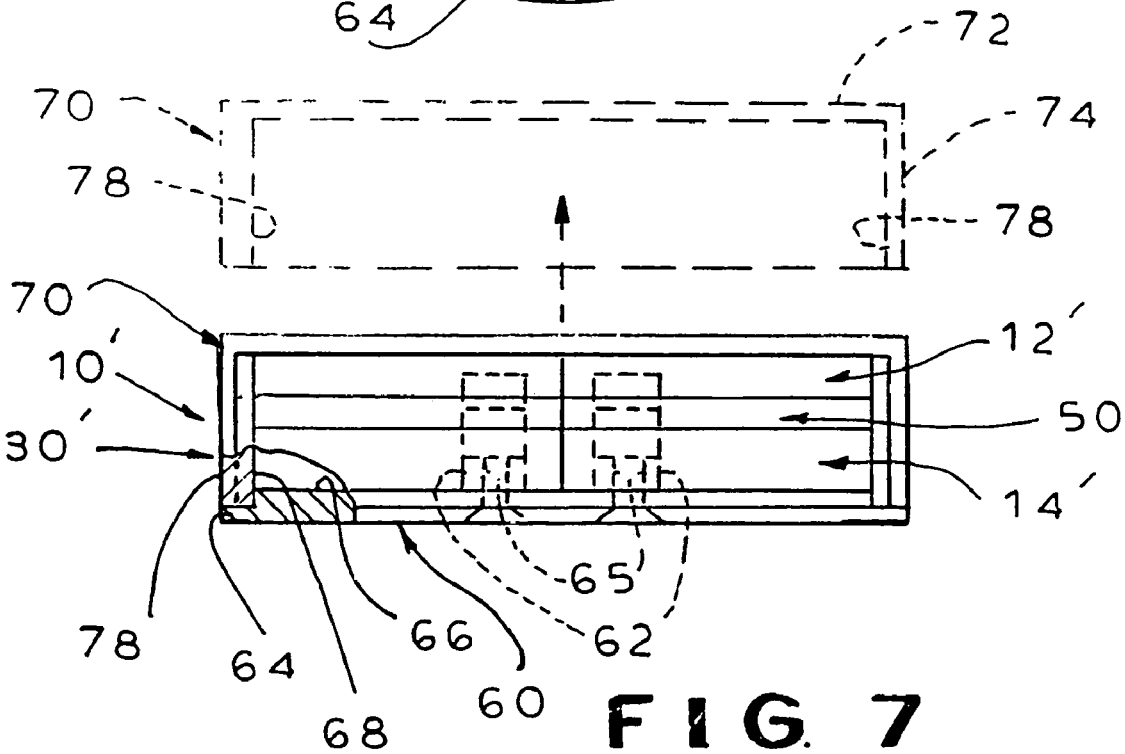
FIG. 7

FIG. 13
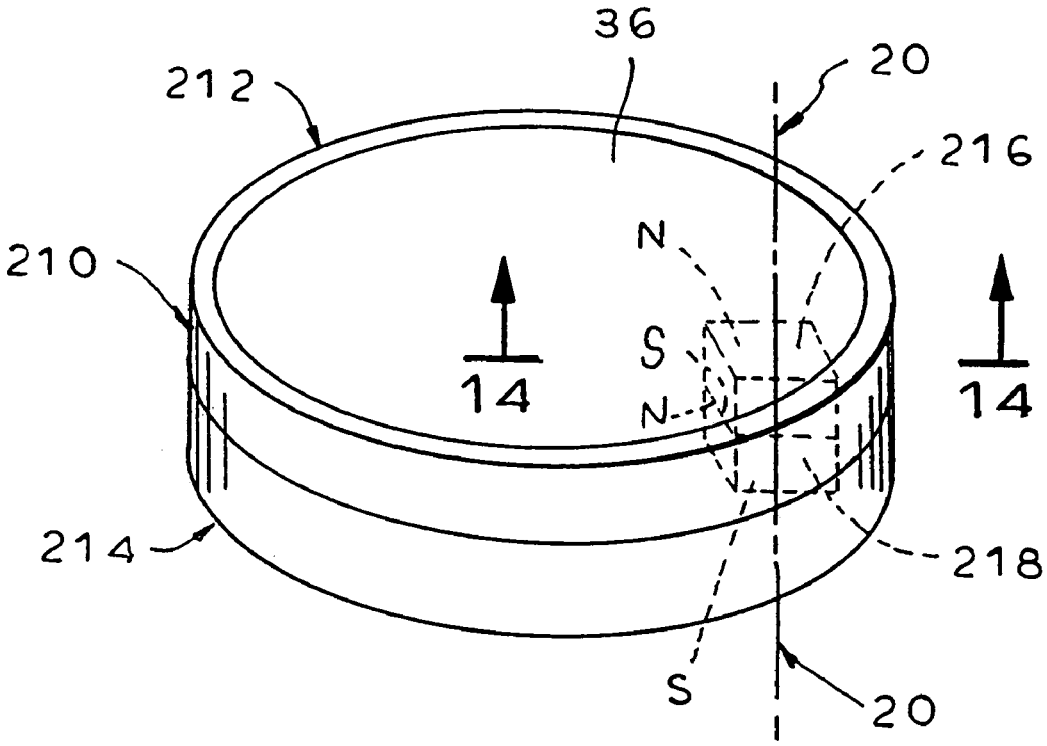
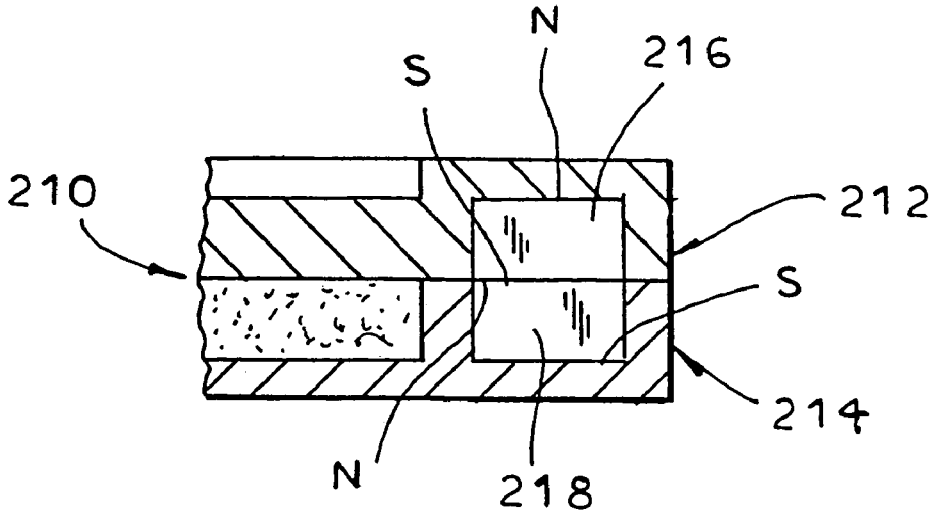
FIG. 14

FIG. 15
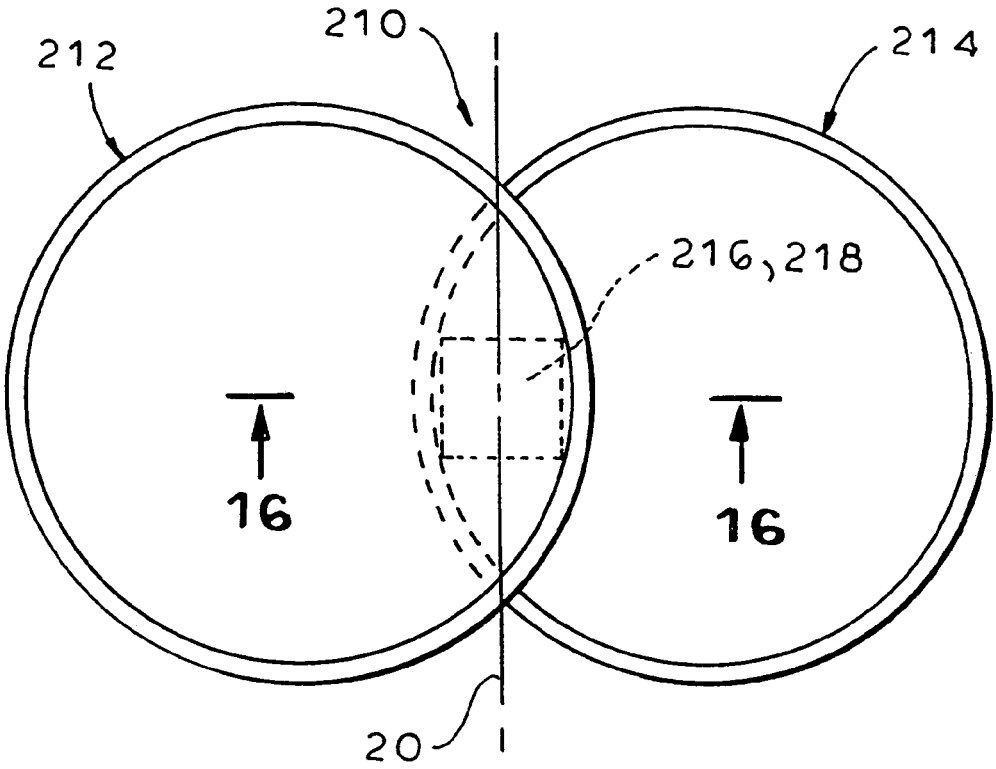
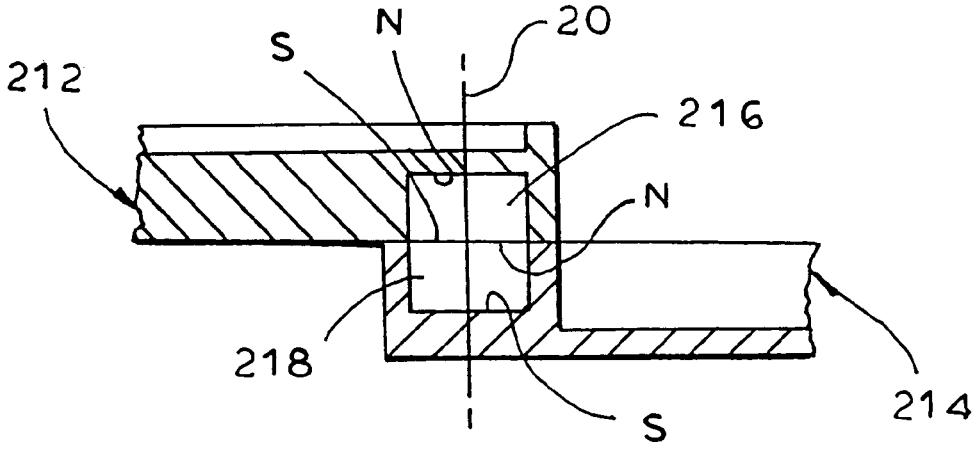
FIG. 16

FIG.17
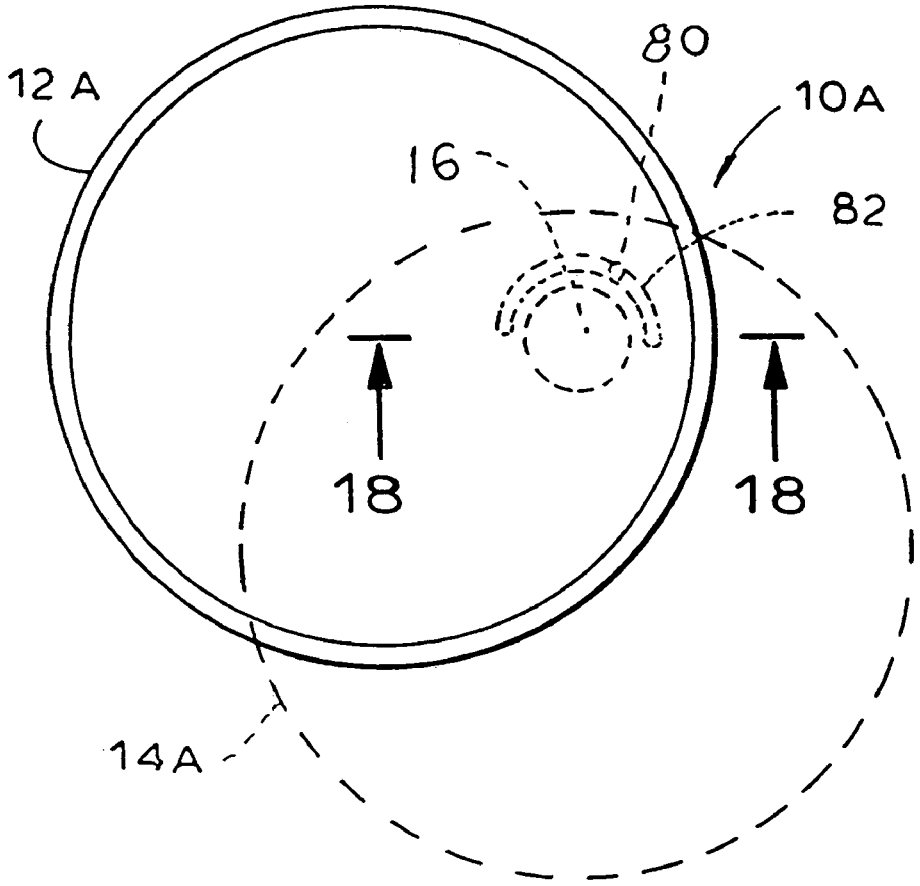
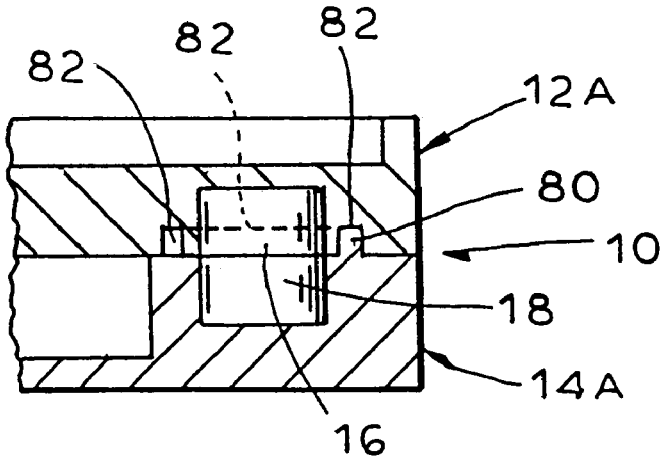
FIG.18

FIG. 20
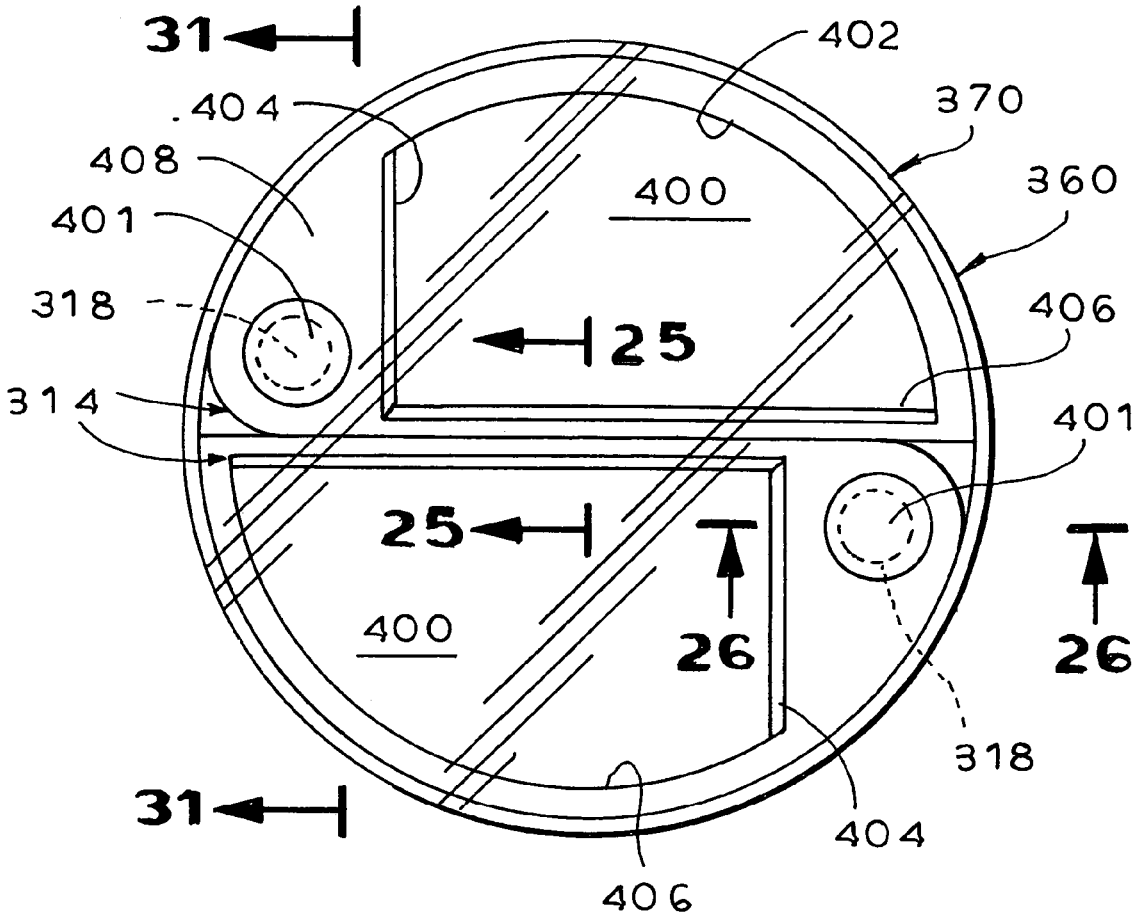
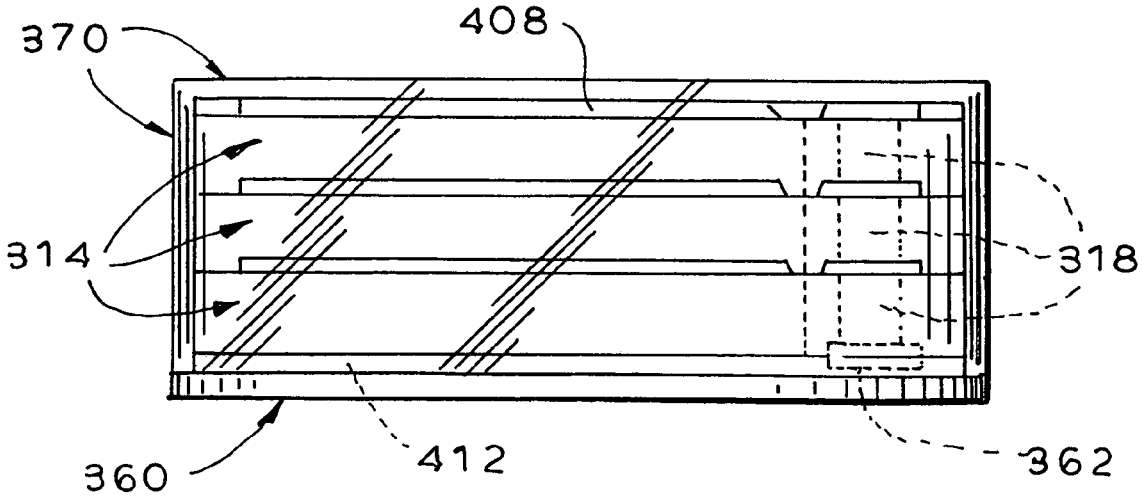
FIG. 21

FIG. 22
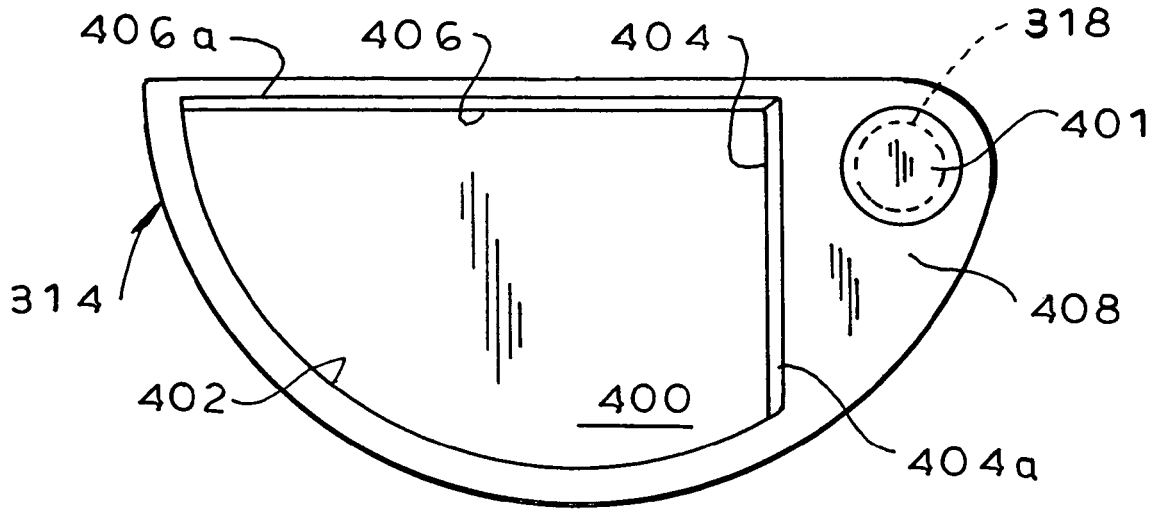
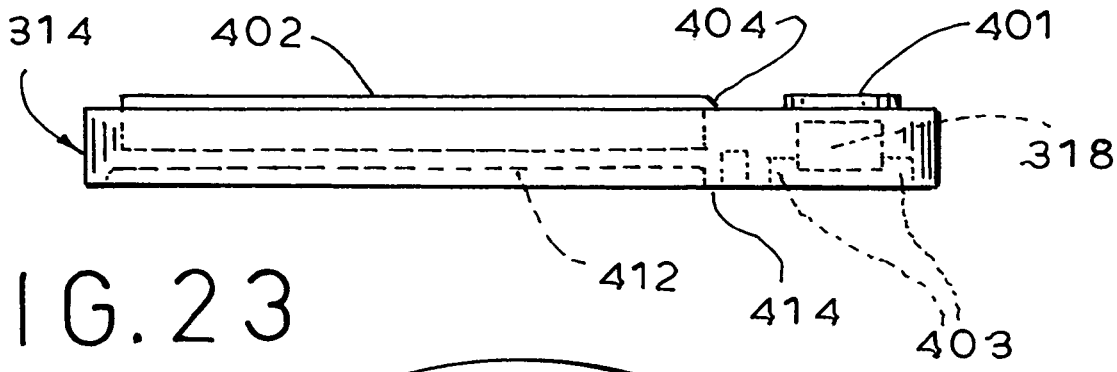
FIG. 23
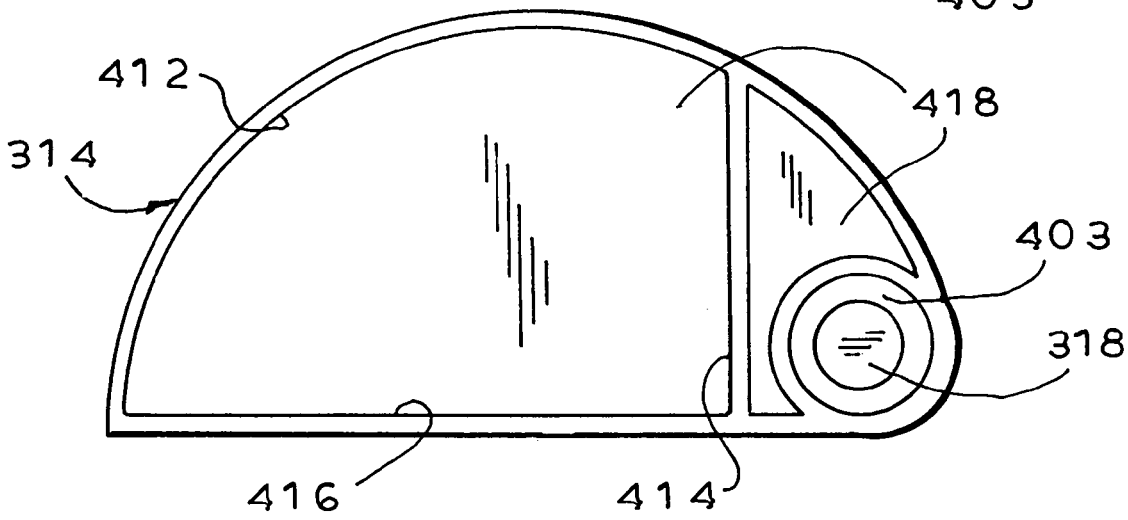
FIG. 24

FIG. 27
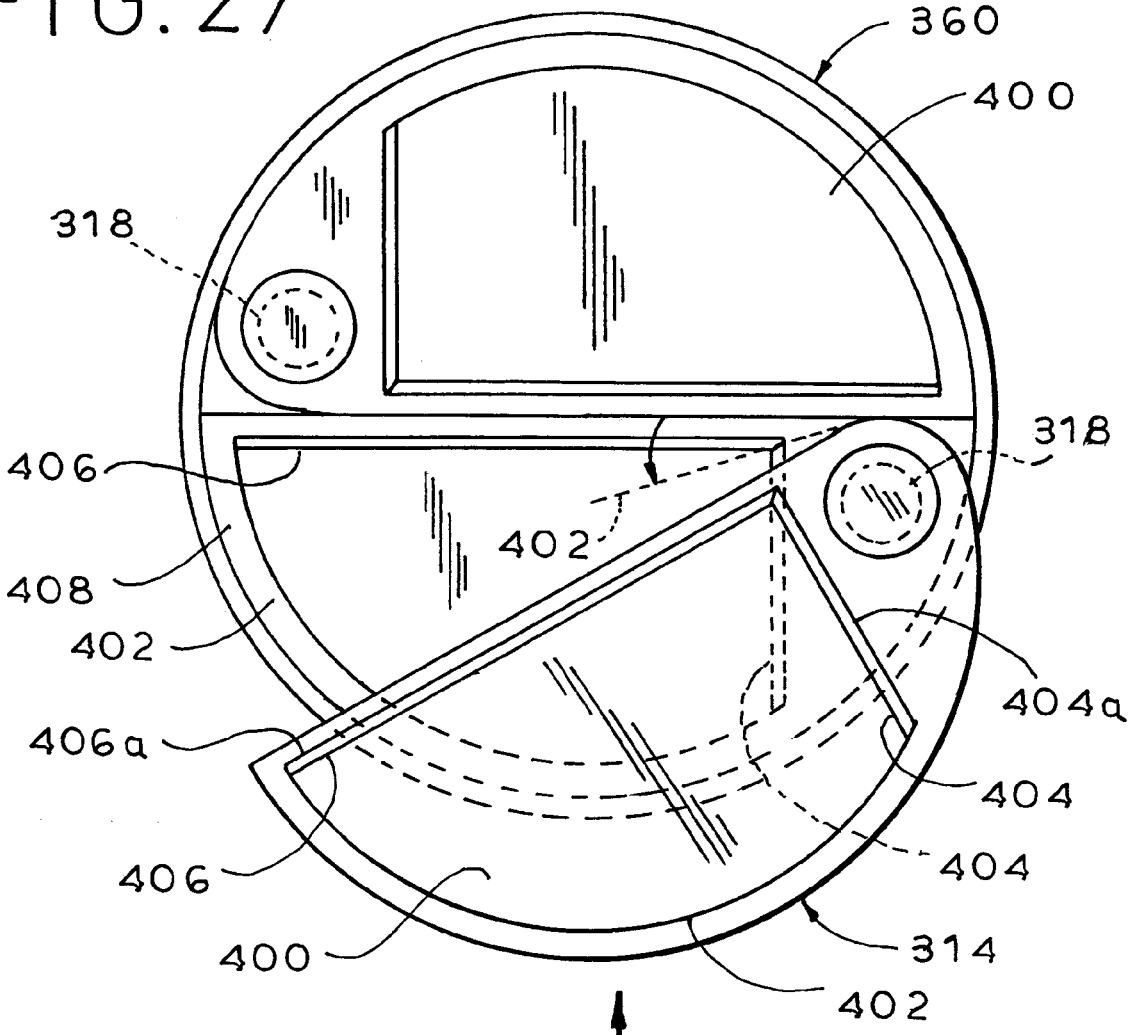
28
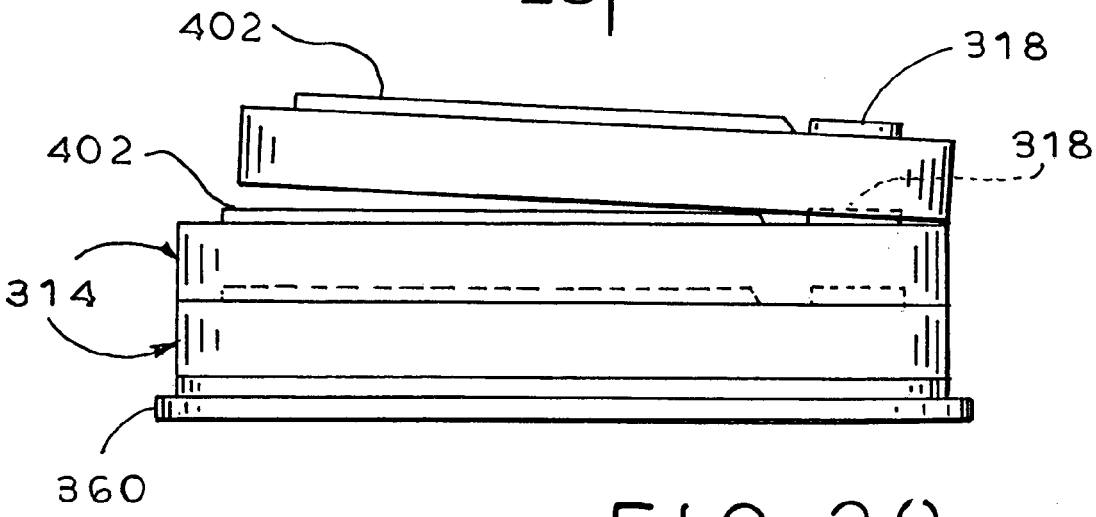
FIG. 28

FIG. 39
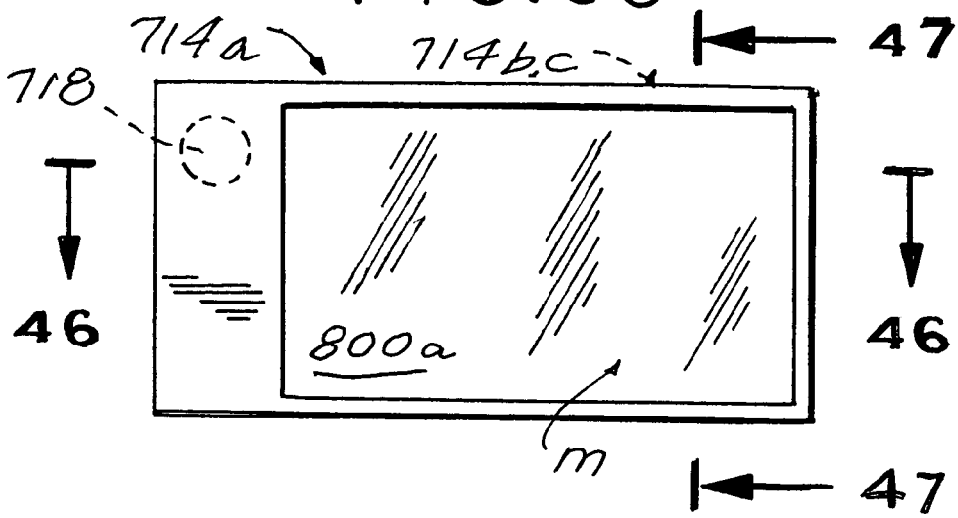
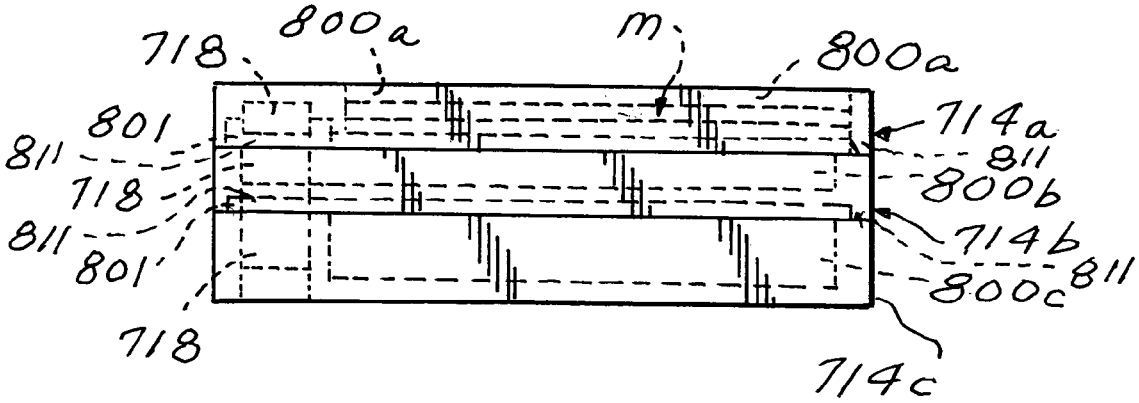
FIG. 40
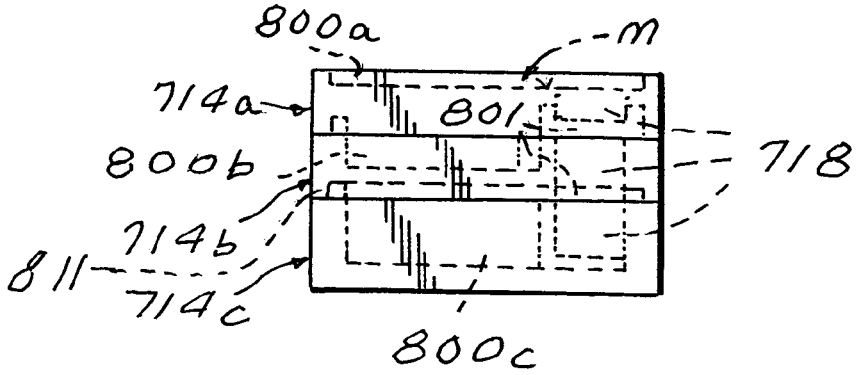
FIG. 41

MAGNETIC HINGE

CROSS-REFERENCE TO RELATED APPLICATION

This is a continuation-in-part of U.S. patent application Ser. No. 10/093,919, filed Mar. 7, 2002 now abandoned.

BACKGROUND OF THE INVENTION

The present invention relates to a hinge, and more particularly to a magnetic hinge.

A conventional physical hinge consists of a pair of hinge plates in parallel plains pivotably secured together by a hinge pin enabling movement of the hinge plates between first and second orientations relative to one another. The hinge pin defines the common pivot axis of the hinge plates. For ease of reference, the first and second orientations are commonly referred to as the "closed" and "open" orientations. In the closed orientation the first and second plates substantially overlapping, while in the open orientation the first and second plates are substantially non-overlapping. While the conventional physical hinge typically performs well in a variety of different environments, it has not proven to be entirely satisfactory in particular environments for one or more of the following reasons:

1. The conventional physical hinge is either internally or externally hinged. When two structural components are externally hinged, the overall dimensions of the structural components (e.g., the hinge plates) must be increased to incorporate the physical hinge pin and also so that at least one edge of each structural component is at least partially wrapped around the common hinge pin; this is disadvantageous as it increases the size of the structure formed by the structural components. Where the structural components are internally hinged (that is, the physical hinge pin is either disposed between the structural components when the hinge is in the closed orientation or extends transversely through the structural components), some of the space between or extending through the structural components must be sacrificed to allow for the volume occupied by the physical hinge pin. In other words, the conventional physical hinge either limits the compactness of the structure employing it or requires a portion of the otherwise useable space within a structure be dedicated to the hinge pin.

2. The conventional physical hinge is not readily deconstructed—that is, in order to separate the hinge plates from one another, typically either the hinge pin must first be removed from the hinge or the edge portion of at least one of the hinge plates which at least partially wraps around the hinge pin must be stretched, broken or the like to enable its separation from the hinge pin. This is frequently an arduous and difficult operation, often as arduous and difficult as the reconstruction or reconstitution of the hinge subsequently when the same is desired. Thus the conventional physical hinge has hinge plates which are neither readily manually separable from one another nor readily manually joinable together (with the hinge pin), as desired.

3. The conventional mechanical hinge is by its nature neither monostable nor bistable—that is, it favors positioning of the hinge plates in neither the closed nor open orientations, as opposed to any of the intermediate orientations. While in many applications it is preferred that the hinge remain with the hinge plates in whatever orientation they were last left by the user, in other applications it is preferred that the hinge be biased to assume an open orientation, a closed orientation or either orientation. It is typically necessary for the conventional mechanical hinge to employ a biasing element (or gravity) acting on at least one of the hinge plates if the hinge is to be monostable, (i.e., biased to a preferred orientation) or bistable (i.e., biased to one of two preferred orientations as opposed to an intermediate orientation therebetween).

Accordingly, it is an object of the present invention to provide a magnetic hinge wherein in one preferred embodiment the hinge is characterized by a virtual hinge axis.

Another object is to provide such a magnetic hinge wherein in one preferred embodiment there is no physical hinge pin either to increase the physical dimensions of the hinge or to occupy space within the hinge plates.

A further object is to provide such a hinge wherein in one preferred embodiment the hinge plates are readily manually separable to deconstruct the hinge and readily manually joinable to reconstitute the hinge.

It is also an object of the present invention to provide such a hinge wherein in one preferred embodiment the hinge is bistable.

It is another object to provide various devices which may profitably incorporate such a hinge.

SUMMARY OF THE INVENTION

It has now been found that the above and related objects of the present invention are obtained in a magnetic hinge defining a hinge axis comprising a first hinge plate of non-magnetic material and a first magnet disposed in the first plate for movement therewith, as well as a second hinge plate of non-magnetic material and a second magnet disposed in the second plate for movement therewith. The first and second plates are generally juxtaposed and independently pivotable about the hinge axis between a closed orientation, wherein the first and second plates are essentially superposed, and an open orientation, wherein the first and second plates are essentially not superposed. The first and second magnets are generally juxtaposed and generally aligned with each other; they are essentially superposed and in the same magnetic orientation.

In a preferred embodiment, the first plate and the first magnet are readily manually separable from the second plate and the second magnet to deconstruct the hinge, and the first plate and the first magnet are readily manually joinable with the second plate and the second magnet to reconstitute the hinge.

In another preferred embodiment, the first and second plates are relatively pivotable about the hinge axis to a plurality of orientations intermediate the closed and open orientations. The hinge axis is stationary, and the hinge is devoid of a physical hinge pin extending through the first and second plates. The hinge axis is disposed inwardly of the peripheries of the first and second plates in both the closed and open orientations. The first and second magnets are preferably coaxial with the hinge axis.

Where the first and second magnets are cylindrical, the hinge is not bistable. Where the first and second magnets are non-cylindrical (e.g., rectangular in plan), the hinge is at least bistable. In both of the bistable orientations the first and second magnets are longitudinally aligned, essentially superposed, and in the same magnetic polar orientation, the first and second magnets being longitudinally realigned by 180°.

In a further preferred embodiment, the first and second magnets incorporate means to preclude movement of the first and second magnets transverse to the hinge axis while enabling independent pivotal movement of the first and second plates about the hinge axis. For example, one of the first and second magnets may project outwardly from the plane of its respective plate, and the other of the first and second magnets may be recessed inwardly within the plane of its respective plate. Alternatively, the first and second plates define a pair of adjacent facing surfaces incorporating cooperating means to preclude movement of the first and second plates transverse to the hinge axis while enabling independent pivotal movement of the first and second plates about the hinge axis. For example, one of the adjacent facing surfaces may define a pin projecting towards the other adjacent facing surface, and the other adjacent facing surface may define an arcuate recess receiving the pin therein and constraining the pin to movement along the recess during pivoting of the plates relative to one another.

The hinge may additionally include at least one third plate of non-magnetic material disposed at least partially intermediate the first and second plates and incorporating means cooperating with the movement-precluding means of the first and second magnets or the first and second plates for precluding non-pivotal movement of the at least one third plate relative to the hinge axis.

Where the plates are semi-cylindrical, the hinge axis is adjacent one end of the plates and remote from the other end of the plates. The hinge preferably additionally includes removable means for maintaining the plates in the closed orientation.

In one application of the hinge, a cosmetic case incorporates the hinge, the first plate defining a base of the case and the second plate defining a cover of the case, the base and cover being relatively pivotable about the hinge axis between the closed and open orientations.

The present invention also encompasses, in combination, a pair of the hinges and common means for maintaining the hinge axes of the pair of hinges in fixed spatial relationship, the first plates together in the closed orientation defining substantially a full cylinder, and the second plates together in the closed orientation defining substantially a full cylinder. The first and second plates of one hinge are separately and independently pivotable relative to both the common means and the first and second plates of the other hinge. The combination additionally includes removable means to preclude pivoting of the first and second plates.

The present invention further encompasses the aforesaid magnetic hinge including at least one third hinge plate of non-magnetic material disposed at least partially intermediate the first and second plates. The first, second and third plates are generally juxtaposed and independently pivotable about the hinge axis between a closed orientation, wherein the first, second and third plates are essentially superposed, and an open orientation, wherein at least one of the first, second and third plates is essentially not superposed with the others. The first and second magnets are essentially superposed and in the same magnetic orientation.

In a preferred embodiment, each of the first and second magnets projects outwardly from the plane of its respective plate towards the other of the magnets, and the third plate defines an aperture there through aligned with the hinge axis. Each of the first and second magnets has a projecting end in contact with the other magnet within the third plate aperture, and the third plate is pivotable about the hinge axis and the projecting ends of the first and second magnets.

The hinge is characterized by the absence of a third magnet.

In another preferred embodiment, the first and second magnets incorporate means to preclude movement of the first and second magnets transverse to the hinge axis while enabling independent pivotal movement of the first, second and third plates about the hinge axis. More particularly, the third plate incorporates means to preclude movement of the first and second magnets or the first and second plates transverse to the hinge axis while enabling pivotal movement of the first, second and third plates about the hinge axis.

The present invention also encompasses, in combination, a pair of the hinges and common means for maintaining the hinge axes of the pair of hinges in fixed spatial relationship, the first plates together in the closed orientation defining substantially a full cylinder, the second plates together in the closed orientation defining substantially a full cylinder, and the third plates together in the closed orientation defining substantially a full cylinder.

Preferably, the first, second and third plates of one hinge are separately and independently pivotable relative to both the common means and the first, second and third plates of the other hinge. The common means may comprise a common base and a pair of pins projecting upwardly from the common base in fixed spatial relationship, each pin spatially fixing the hinge axis of a respective one of the hinges. The pins are either in close side-by-side juxtaposition or, preferably, at opposed ends of the common base.

The combination may additionally include removable means (e.g., a removable cover) to preclude pivoting of the first, second and third plates.

BRIEF DESCRIPTION OF THE DRAWING

The above and related objections, features and advantages of the present invention will be more fully understood by reference to the following detailed description of the presently preferred, albeit illustrative, embodiments of the present invention when taken in conjunction with the accompanying drawing wherein:

FIG. 6 is a top plan view thereof with a portion of the transparent cover cut away to reveal details of internal construction;

FIG. 7 is a side elevational view thereof with portions broken away to reveal details of internal construction and with the transparent cover also illustrated in phantom line separated from the remainder of the hinge;

FIG. 13 is an isometric view of a bistable third embodiment of the present invention;

FIG. 14 is a fragmentary sectional view thereof taken along the line 14—14 of FIG. 13;

FIG. 15 is a top plan view of the third embodiment with the plates in the open orientation;

FIG. 16 is a fragmentary sectional view thereof taken along the line 16—16 of FIG. 15;

FIG. 17 is a top plan view of a variant of the first embodiment, with the bottom plate being illustrated in phantom line in an open orientation;

FIG. 18 is a fragmentary sectional view thereof taken along the line 18—18 of FIG. 17;

FIG. 20 is a top plan view thereof;

FIG. 21 is a side elevational view thereof;

FIG. 22 is a side elevational view of a basic piece of the fourth embodiment;

FIG. 23 is a top plan view thereof;

FIG. 24 is a bottom plan view thereof;

FIG. 27 is a view similar to FIG. 20, but without the cover and with one top basic piece being illustrated in a partially open orientation;

FIG. 28 is a side elevational view thereof, taken in the direction of arrow 28 of FIG. 27;

FIG. 39 is a top plan view thereof;

FIG. 40 is a side elevational view thereof;

FIG. 41 is an end elevational view thereof;

DETAILED DESCRIPTION OF THE PREFERRED EMBODIMENTS

Figure 1:
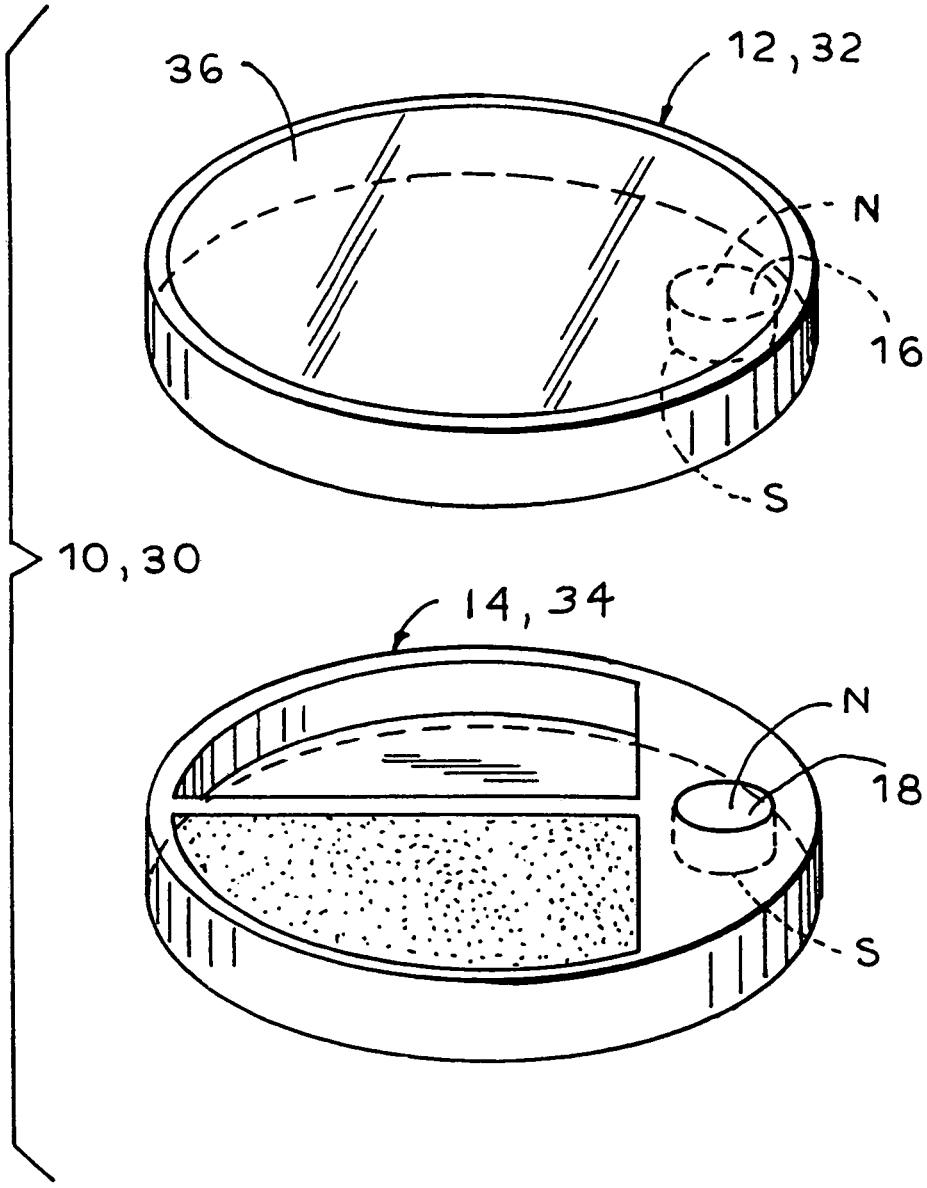
FIG. 1 is an isometric view of a first embodiment of the present invention with the plates in a separated state.
Figure 4:
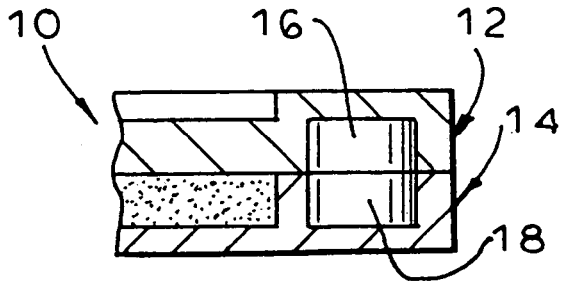
FIG. 4 is a fragmentary sectional view taken along the line 4—4 of FIG. 3.

Consonant with the description of a conventional mechanical hinge as consisting of hinge plates and a hinge pin pivotally connecting the hinge plates, the following description employs the term "hinge plate" or "plate." However, it should be appreciated that, as in the conventional physical hinge, the "plate" need not be flat or thin (as might be suggested by use of the term "plate"), but may alternatively be possessed of an uneven non-flat surface and a thick or irregular non-thin configuration.

Referring now to the drawing, and in particular to FIGS. 1–4 thereof, therein illustrated is a first embodiment of a hinge according to the present invention, generally designated by the reference numeral 10.

The hinge 10 comprises a first hinge plate, generally designated 12, and a second hinge plate, generally designated 14, both plates being of non-magnetic material and disposed in generally juxtaposed relationship, preferably in parallel planes. At least one first bipolar magnet 16 is disposed in the first plate 12 for movement therewith, and at least one second bipolar magnet 18 is disposed in the second plate 14 for movement therewith. Preferably, as illustrated, the first and second magnets 16, 18 and the first and second plates 12, 14, are generally cylindrical with opposite circular faces of each magnet being of opposite magnetic polarity.

Figure 2:
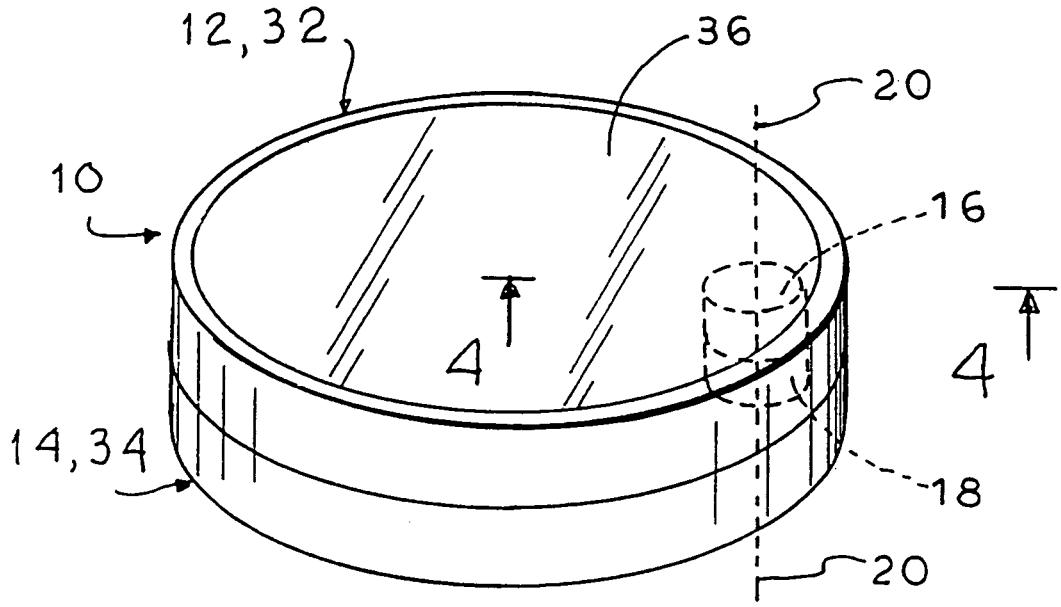
FIG. 2 is an isometric view thereof in a joined state and in the closed orientation.
Figure 3:
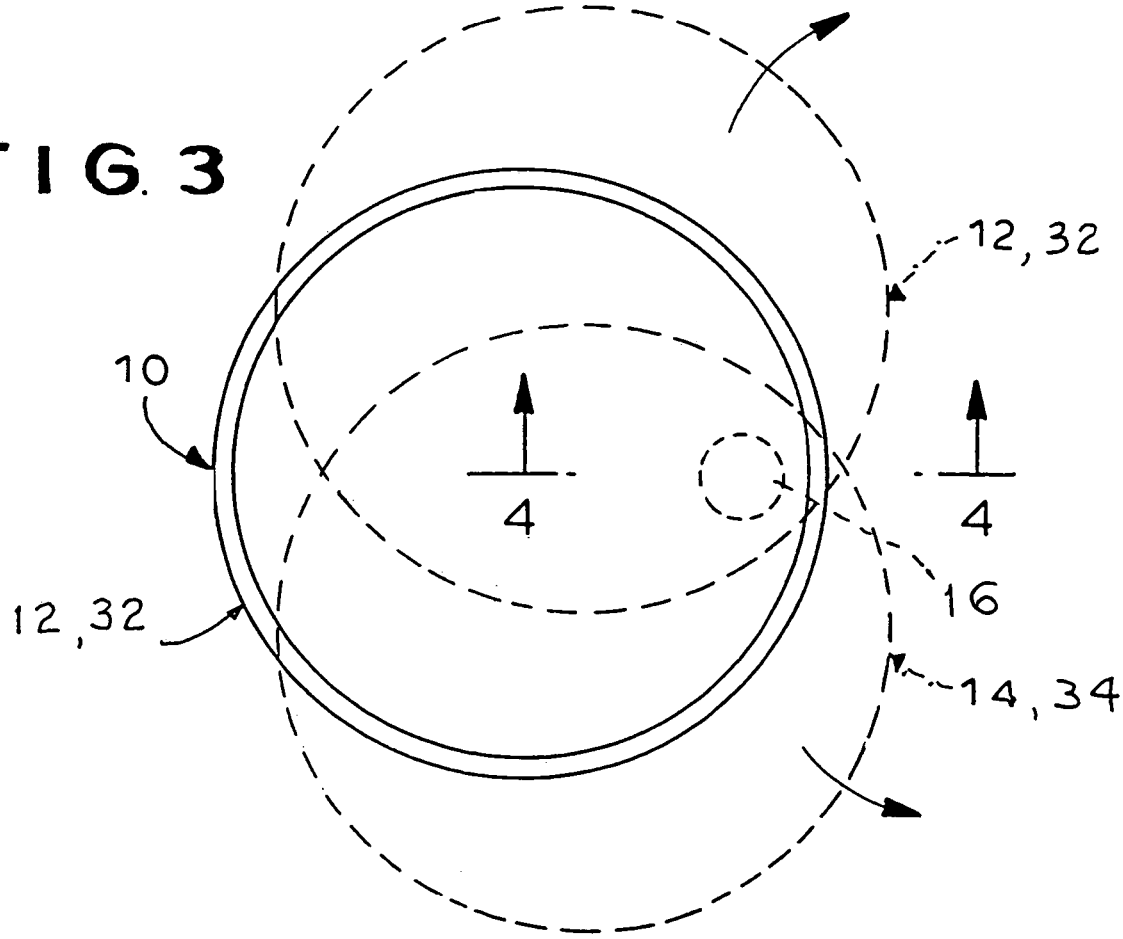
FIG. 3 is a top plan view thereof of with the hinge being shown in a solid line in a closed orientation and in broken line in an open orientation.

The first and second plates 12, 14 are in generally parallel planes, but pivotable about the hinge axis 20 between the closed orientation illustrated in FIG. 2 and in solid line in FIG. 3 and the open orientation illustrated in phantom line in FIG. 3. In the closed orientation the first and second plates 12, 14 are substantially overlapping and preferably essentially superposed, while in the open orientation they are substantially non-overlapping and preferably not essentially superposed. (The term "superposed" is used to mean in complete vertical alignment and not just partially overlapping.) The first and second magnets 16, 18 are generally vertically aligned with each other and coaxially aligned with the hinge axis 20, and in the same magnetic orientation, either

| | | |
|---|---|---|
| N | | S |
| S | or | N |
| N | | S |
| S | | N |

In both the open and closed orientations, the magnets 16, 18 are in a face-to-face orientation, substantially overlapping, and preferably essentially superposed. Preferably, the adjacent faces of the magnets 16, 18 are substantially flush with the adjacent facing surfaces of the plates 12, 14 in which they are disposed and optimally in immediate physical contact with each other.

As illustrated in FIG. 1 in particular, the first plate 12 and the first magnet 16 are readily manually separable from the second plate 14 and the second magnet 18 (in either the open or closed orientation)to deconstruct the hinge 10. Thus, each plate 12, 14 may be removed from the vicinity of the other plate 14, 12 for separate use. As illustrated in FIG. 2 in particular, the first plate 12 and the first magnet 16 are readily manually joinable with the second plate 14 and the second magnet 18 to reconstitute or reconstruct the hinge 10 in either the closed or open orientation.

Because the hinge pin is only virtual and not physical, the virtual hinge axis 20 does not increase the physical dimensions of the hinge 10 and the virtual hinge axis 20 does not physically occupy space immediate the hinge plates 12, 14. As the hinge axis 20 neither increases the physical dimensions of the hinge nor physically occupies space intermediate the hinge plates, the hinge can be extremely compact and allow maximum utilization of the space intermediate the plates.

The magnets 16, 18 are preferably of small size but significant magnetic strength and may be formed of alnico, neodymium (a rare-earth metal) or like materials of high magnetic flux. Preferably the magnets 16, 18 are of sufficient magnetic strength that, in the absence of an intentional effort to separate the plates 12, 14, they maintain themselves coaxial with hinge axis 20 extending there through. That is, the magnets are sufficiently strong to preclude movement thereof transverse to the hinge axis 20, while still enabling independent rotation thereof (and thus rotation of the first and second plates 12, 14) about the hinge axis 20.

If desired, the first and second magnets 16, 18 may incorporate means cooperatively precluding movement thereof transverse to the hinge axis 20, while still enabling independent pivotable movement of the first and second plates 12, 14 about the hinge axis 20. To this end, one magnet 16, 18 may project slightly from the inwardly facing surface of its respective plate 12, 14 (rather than being flush therewith), and the other magnet 18, 16 may be slightly recessed from the inwardly facing surface of its respective plate 14, 12 (rather than being flush therewith). Thus the projecting portion of the first-mentioned magnet may extend into and be received in the recess associated with the second-mentioned magnet. In this projection/recess system the two magnets 16, 18 cooperatively act as a single hinge pin to preclude transverse movement of the plates 12, 14 relative to the hinge axis 20. If projecting magnet 16 is of sufficient magnetic strength, recessed magnet 18 may be replaced by a simple metal plate attracted by magnet. 16.

Optimally, the magnets 16, 18 maintain the adjacent facing surfaces of the plates 12, 14 in such close frictional contact that the plates 12, 14 will remain in the closed orientation unless and until intentionally manually moved to the open orientation. Where the friction between the adjacent facing surfaces of the plates 12, 14 is not adequate for maintaining the plates 12, 14 in the closed orientation under normal conditions of storage (for example, in a ladies handbag), releasable cover means may be provided for maintaining the plates 12, 14 in the closed orientation. For example, a removable transparent cover open at one end and having substantially the same configuration and dimensions as the outer surface of the plates may be provided. It may also be desirable to provide a releasable cover for protection of the outwardly facing opposed surfaces of the plates 12, 14 or their contents (e.g., where they contain mirrors).

While the plates 12, 14 have been shown and described as being cylindrical (that is, circular in plan) or semi-cylindrical, alternatively they may be formed of other configurations, for example, polygons, or the like. Where the plates are semi-cylindrical, the hinge axis 20 is preferably adjacent one end of the plates and remote from the other end of the plates. Where the plates are polygonal, preferably the hinge axis is closely adjacent one angle of the polygonal outline and remote from the other angles.

Referring now to FIGS. 17–18, therein illustrated is a variant hinge 10A wherein the plates 12A, 14A incorporate means cooperatively precluding movement thereof transverse to hinge axis 20, while still allowing pivotal movement thereabout. In such a variant 10A one of the plates 14A, 12A defines a preferably circular projection 80 spaced from the hinge axis 20 and closely about its magnet 18, 16, while the opposite plate 12A, 14A defines an arcuate or circular recess 82 coaxial with the hinge axis 20 and closely about its magnet 16,18. The recess 82 is configured and dimensioned to receive therein the projection 80, while still allowing for independent rotation of the plates about the hinge axis 20. Thus, the bottom face of the first or upper plate 12A may have a downwardly opening arcuate groove or recess 82, while the top face of the second or lower plate 14A may have an upwardly extending projection 80, or vice versa. The projection 80 is received within the groove or recess 82, regardless of whether the plates are in the open or closed orientation. This construction precludes sliding movement of the plates transverse to the hinge axis 20. It will be appreciated, however, that the use of a projection/recess system in the plates 12A, 14A increases the effective diameter of the hinge axis 20 more than when the projection/recess system is in the magnets 16, 18 only. Of course, if desired, both projection/recess systems may be employed concurrently.

The hinge 10 of the present invention may be incorporated in a wide variety of different consumer and industrial products. By way of example, the hinge 10 is illustrated in the context of a modular hinge compact or cosmetic case, generally designated 30. One of the plates (here, upper plate 12) defines a cover 32 of the case 30, and the other of the plates (here, lower plate 14) defines a base 34 of the case 30, the base 34 and cover 32 being movable between closed and open orientations, as illustrated. Optionally, as illustrated, the cover 32 includes in a recess on its top surface a mirror 36, and the base 34 includes in an open-top compartment thereof a cosmetic 38 (such as a powder, base, lipstick, eyeshadow or the like) which may be applied while looking into the mirror 36 or "checked" thereafter by looking into the mirror 36. Alternatively, or in addition thereto, an appropriate recess 42 may be provided in the base 34 for storage of a cosmetic applicator (such as a powder brush, eyeliner pencil, lipstick brush or the like). The mirror 36 is preferably slightly recessed in the cover 32 for protection against scratching.

Because the cover 32 and base 34 of the compact 30 (i.e., first plate 12 and second plate 14 of hinge 10) may be manually readily separated from one another, as illustrated in FIG. 1, the separated mirror-containing cover 32 may conveniently be leaned against a separate support ease of viewing while the user holds the base 34 and applies the cosmetic 38 therefrom.

Conveniently, the cosmetic 38 may be disposed in a removable pan (not shown) which is insertable into and removable from the base 34 with the cosmetic 38 therein as a unit. Of course, the pan may be divided to hold more than one cosmetic 38, and, indeed, the base 34 may be configured to hold a plurality of smaller pans rather than a single large pan. Where the pans are releasably maintained in base 34, they are easily replaceable to allow interchanging of different colored eye shadow, face powder or lipstick combinations.

A preferred cylindrical compact case 30 according to the present invention may have a plate diameter as small as 2", a magnet diameter as small as ¼", and a thickness or depth as small as ½". No internal volume of the compact is wasted on a physical hinge pin.

Referring now to FIGS. 5–10, therein illustrated is a second embodiment of a hinge according to the present invention, generally designated 10'. Components of the second embodiment hinge 10' having a similar structure or function to components of the first embodiment hinge 10 will be designated by the same reference numeral.

In the second embodiment, the hinge 10' utilizes plates 12', 14' that are substantially semi-cylindrical rather than cylindrical. Two of the semi-cylindrical hinges 10' are used in combination, side-by-side, in a given compact case 30' so that the overall appearance of compact 30' is generally similar to that of compact 30 using a single hinge 10. The compact 30' provides additional compartments for the compact 30' by adding to each hinge 10' a third or intermediate plate, generally designated 50, disposed between the first and second plates 12', 14'. The presence of the third plate 50 typically increases the thickness of the compact 30 by less than one-half. As the contents of the third plate 50 are generally better protected then the upper surface of the first plate, in the compact 30' the mirror 36 is typically relocated to lie in a recess on the upper surface of the third plate 50.

Figure 9:
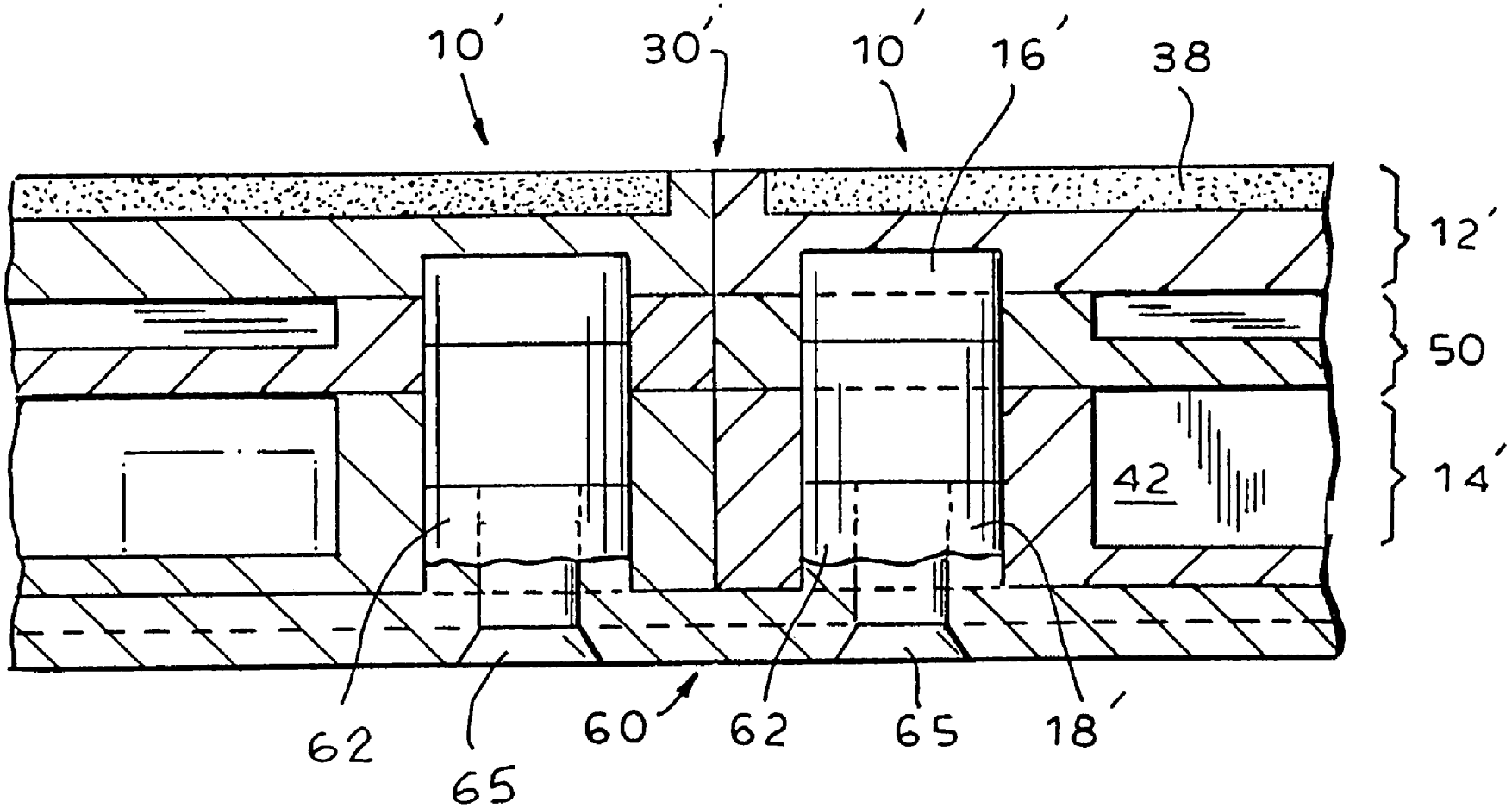
FIG. 9 is a fragmentary sectional view taken along the line 9—9 of FIG. 6.
Figure 10:
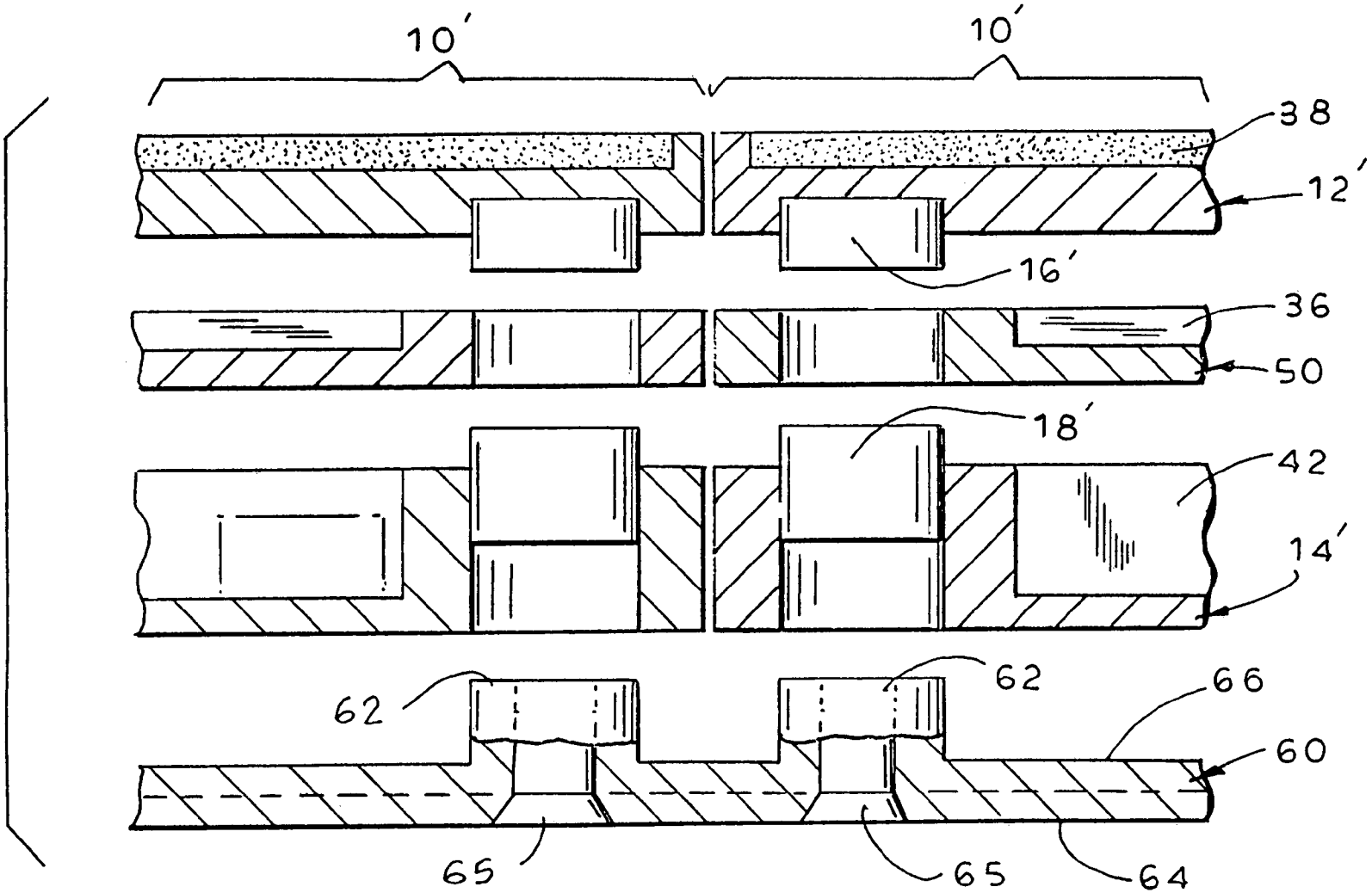
FIG. 10 is an exploded fragmentary sectional view of the hinge shown in FIG. 9.

The third plate 50 does not have a magnet disposed therein for movement therewith. Rather the third plate 50 defines an open-ended chamber or compartment 52 therethrough vertically aligned with magnets 16', 18' and coaxial with the hinge axis 20. Unlike the magnets 16, 18 in the respective plates 12, 14 of the first embodiment hinge 10, the magnets 16', 18' of the second embodiment hinge 10' are not flush with the facing surfaces of the plates 12', 14', but rather project from such surfaces (downwardly in the case of magnet 16' associated with the first or upper plate 12', and upwardly in the case of magnet 18' associated with the second or lower plate 14'). Thus, as best seen in FIGS. 7 and 9–10, projecting free ends of magnets 16', 18' each enter into the chamber 52 of third plate 50 from opposite directions. The projecting ends of magnets 16', 18' are preferably closely adjacent, and optimally in contact, within compartment 52, but may be slightly spaced apart. When they are in contact, the combined magnets 16', 18' act physically as a single hinge pin coaxial with hinge axis 20.

Figure 8:
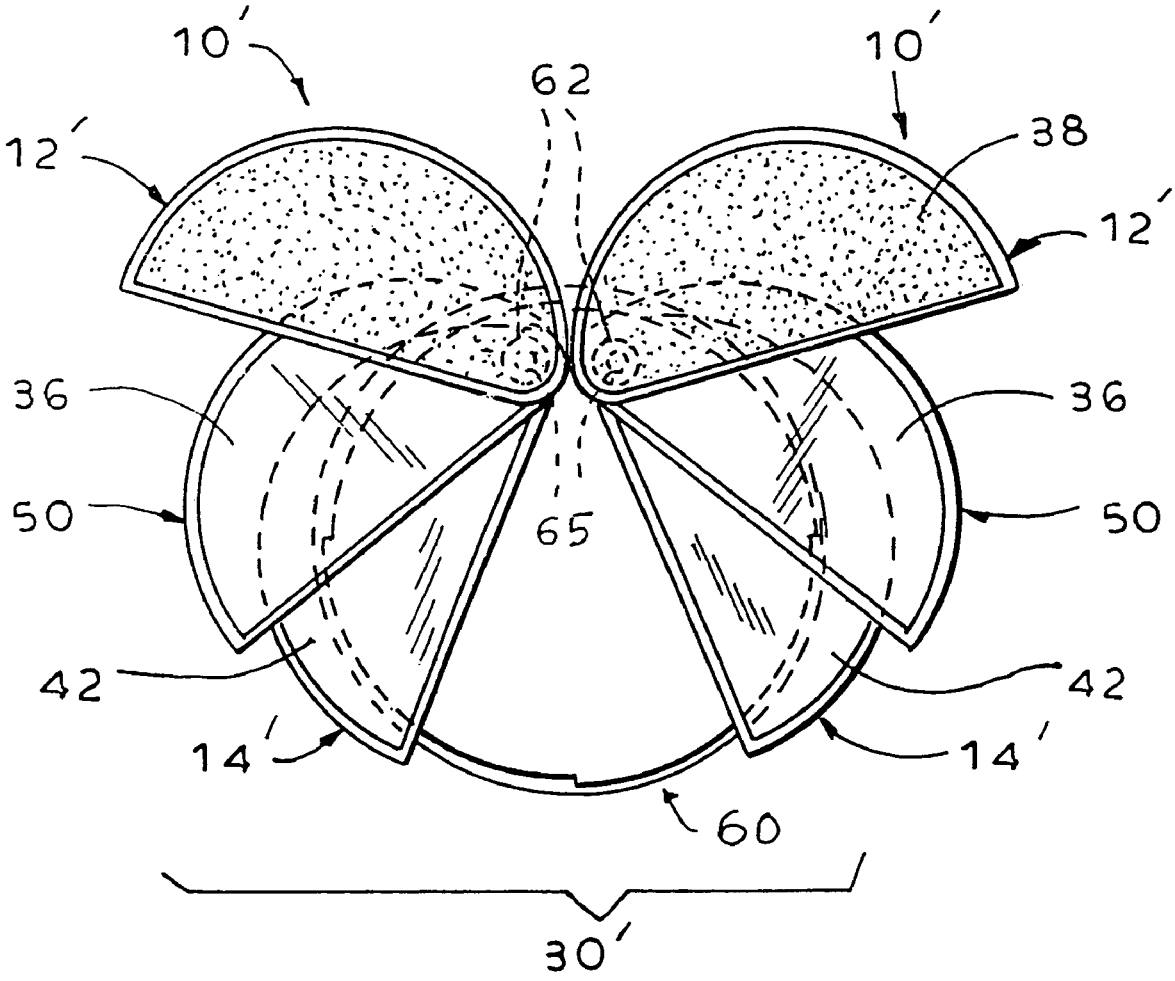
FIG. 8 is a top plan view thereof (without the transparent cover) with the plates being illustrated in an open orientation.

Referring now to FIG. 8 in particular, just as the first and second plates 12', 14' are separately and independently pivotable relative to one another about the hinge axis 20, the third plate 50 may be independently pivoted relative to the first plate 12', the second plate 14', or both, about hinge axis 20.

Just as the first and second plates 12', 14' may be separated from each other, the third plate 50 may be separated from the first and second plates 12', 14' by manually separating the plates 12', 14' until the projecting ends of magnets 16', 18' leave compartment 52. The entire hinge 10" (including third plate 50) may subsequently be reconstituted.

Just as the first and second plates 12', 14' are non-stable, the third plate 50 is non-stable-that is, it is not stable in either of the closed or open orientations.

The compact 30' is further provided with a circular base, generally designated 60, including two juxtaposed upstanding lugs or pins 62. The base 60 is formed of non-magnetic material, and is preferably formed of plastic. The pins 62 are configured and dimensioned to be snugly received within the hollowed out portions of the second plates 14' below the magnets 18', while still allowing free pivotal movement of the plates 14' about the axis 20 of each hinge 10' and separation of the second plate 14' from the base 60. The lateral juxtaposition of the two pins 62 laterally juxtaposes the two hinges 10'.

In the preferred embodiment illustrated, metal members 65 extend through the upstanding pins 62, the upper surfaces of member 65 and pins 62 preferably being coplanar. The metal members may be in the form of rivets to reinforce the upstanding pins 62 in their relative positions on the base 60. Where the metal member 65 is either magnetic or magnetizable (by close proximity to the magnets 18'), they serve the additional function of assisting in maintenance of the hinges 10' on the base 60 by providing a magnetic connection between the hinges 10' and the base pins 62, thereby preventing an accidental separation of the hinges 10' from the base 60 should the compact 30' be accidentally jarred.

In addition to the relatively planar circular bottom 64, the base 60 includes immediately above the bottom 64 a locking member 66 preferably defining a plurality (here, four) spiral shaped segments 68. Each segment 68 gradually increases in diameter from one end to the other and thus approaches the diameter of the bottom 64, although stopping short thereof.

In addition to the base 60, the compact 30' additionally includes a removable cover, generally designated 70. The cover 70 is illustrated only in FIGS. 5–7, and for ease of illustration not in FIGS. 8–10. The removable cover 70 is formed of non-magnetic material and is preferably formed of a transparent plastic so that the cosmetics 38 in the first plates 12' are visible through the transparent tops 72 of cover 70. When the cover 70 is in place, the depending sidewall 74 of cover 70 extends down to the top of the bottom 64 of base 60. While the cover 70 is in place, on base 60, the sidewall 74 thereof maintains the two hinges 10' in their closed orientation; removal of the cover 70 from the base 60 allows the free and independent pivoting of the plates 12', 50, 14' of each hinge 10' about a respective hinge axis 20, each plate 14' also being pivotable about the pin 62 therein.

The cover sidewall 74 preferably defines a plurality (here, four) spiral segments 78 corresponding to the segments 68 of base 60. But while base segments 68 extend outwardly toward the periphery of base 60, the cover segments 78 extend inwardly from the periphery of sidewall 74 and are configured and dimensioned so that, when the segments 68, 78 are in the same horizontal plane, appropriate rotation of the base 60 and cover 70 effects a compression fit of the cover 70 and base 60. The compression fit maintains the cover 70 on the base 60 until counter-rotation of the base 60 and cover 70 releases the compression fit.

Figure 5:
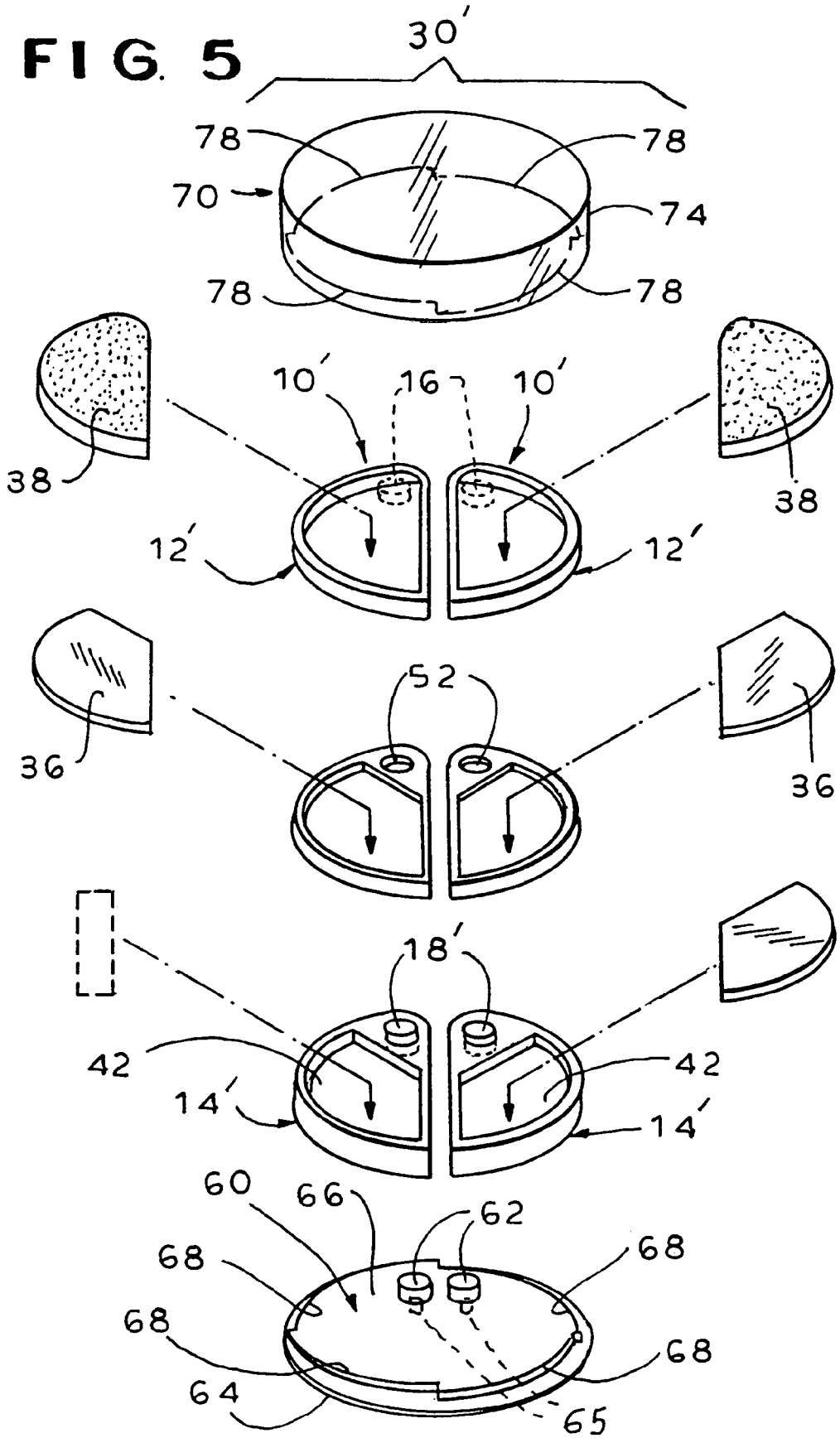
FIG. 5 is an exploded isometric view of a second embodiment of the present invention.

It will be appreciated that the outward pivoting of the various plates 12', 50, 14' about the hinge axis 20 of the respective hinge 10' is limited, as illustrated in FIG. 8, by the abutments of the several plates of one hinge 10' against the corresponding plates of the other hinge 10'. Indeed, in order to achieve even the amount of free pivotal movement illustrated in FIG. 8, the corners of the semi-cylindrical plates adjacent the hinge axis 20 must be somewhat curved. This degree of curvature can be used to limit the outward pivoting of the plates to a desired level. Thus, careful design of the laterally adjacent surfaces of the two hinges 10' in the second embodiment of the present invention, as illustrated in FIGS. 5–10, is critical to avoid undue limitation of the free pivotal movement of the plates 12', 50, 14' of one hinge 10' relative to the corresponding plates 12', 50, 14', respectively, of the other hinge 10'. And even with careful design, some limitation on the free pivotal movement of the plates of one hinge 10' relative to the plates of the other hinge 10' of the compact 30' will typically still exist. Furthermore, the side-by-side close juxtaposition of the upstanding pins 62 on the circular base 60 of compact 30' mandates, as best seen in FIG. 5, that each of the two plates 12', each of the two plates 50 and each of the two plates 14' of the two hinges 10' be manufactured separately (because of their separate configurations) as six separate and distinct components, thereby increasing tooling and molding costs for the compact 30'.

Figure 11:
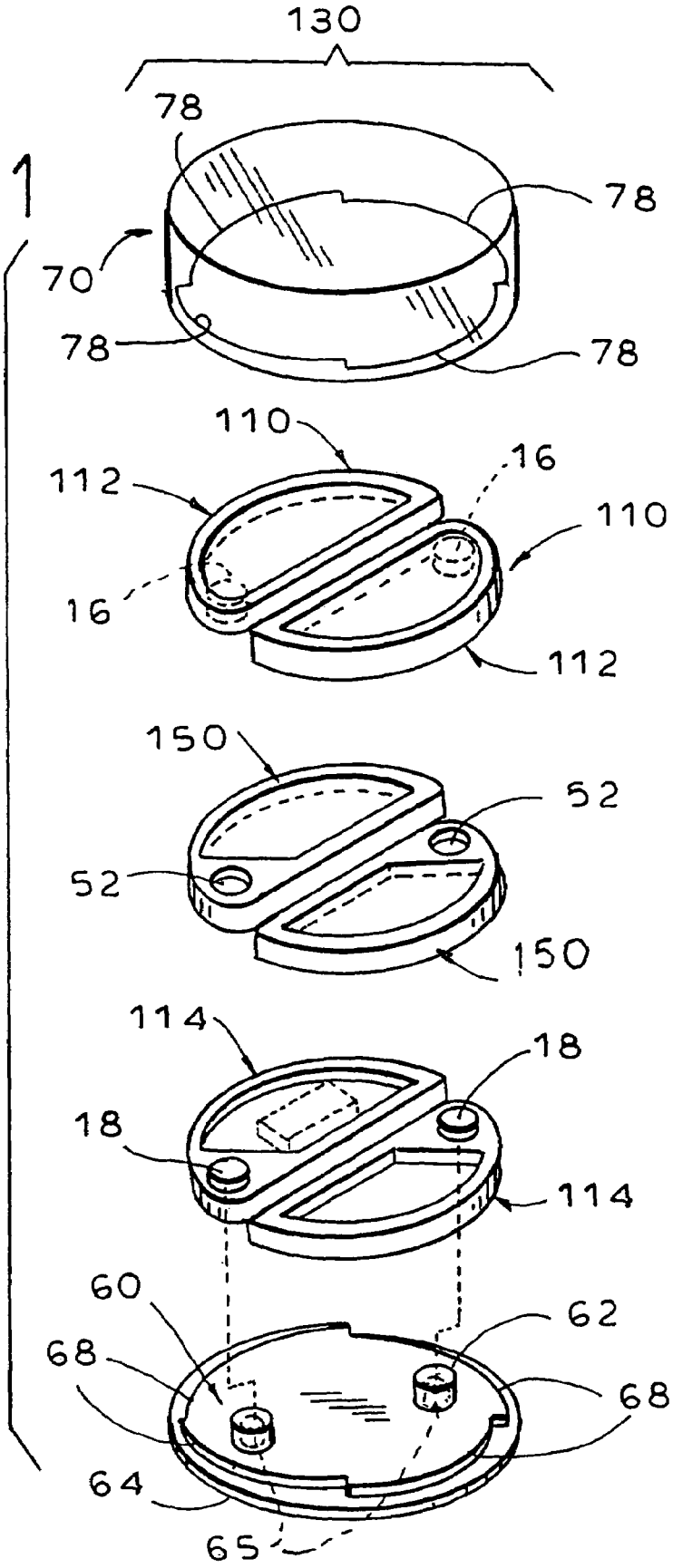
FIG. 11 is an exploded isometric view of a variant of the second embodiment.
Figure 12:
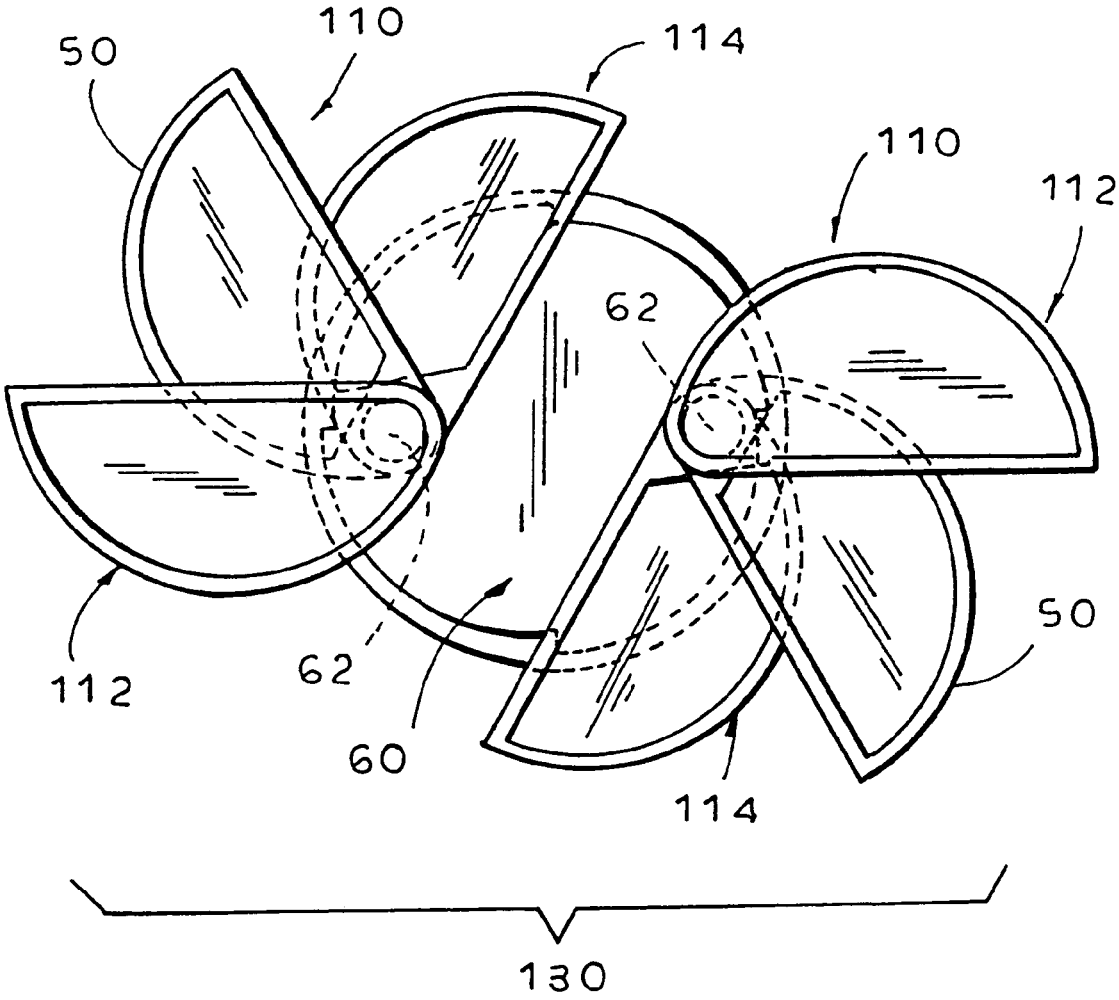
FIG. 12 is a top plan view of the variant (without the transparent cover) with the plates being illustrated in an open orientation.

Accordingly, referring now to FIGS. 11–12 in particular, therein illustrated is a variant of the second embodiment compact 30', the variant being generally designated 130. In the variant compact 130 the upstanding pins 62 of base 60 are not disposed in close side-by-side juxtaposition (as seen in FIG. 5), but rather are widely spaced from one another, preferably essentially at opposite ends of a diameter of the circular base 60 (as illustrated in FIG. 11). As a result of this seemingly inconsequential change in the relative disposition of the upstanding pins 62, in the variant compact 130 both plates 112 of the two hinges 110 are identical, as are the two plates 150 and the two plates 114. Accordingly, since only three plate elements 112, 150 and 114 need be molded, the tooling and molding costs of the variant compact 130 are greatly reduced relative to the second embodiment compact 30'. In addition to this significant advantage to the manufacturer of the variant compact 130, the user of the variant compact 130 benefits as well since, as illustrated in FIG. 12, the two plates of the two variant hinges 110 barely interact with one another during intended operation of the compact 130.

The first embodiment 10 and the second embodiment 10' are essentially non-stable. In other words, the relative orientations of the plates 12, 14 of the first embodiment hinge 10 about the hinge axis 20 may vary freely, and the relative orientations of the various plates 12', 50, 14' of the second embodiment 30' may vary freely. In other words, there exists no preferred or stable orientation of the plates about the hinge axis 20 due to the intrinsic nature of the hinge 10, 10'. Thus, in the first embodiment 10 any restriction of the free pivotal movement of a plate 12, 14 relative to the hinge axis 20 results either from friction or the presence of a cover 70. In the second embodiment 10' any such restriction results from friction, the presence of a cover 70 maintaining the facing linear surfaces of the corresponding plates of the two hinges 10' in abutment, or from the juxtaposition of the two hinges 10' such that the plates of one hinge limit free pivotal movement of the corresponding plates of the other hinge.

It is contemplated that some users of a cosmetic case according to the present invention will prefer such freely rotating plates and the absence of any preferred or stable orientations thereof. However, it is also contemplated that many users would prefer a cosmetic case in which the intrinsic nature of the hinges provided the plates with two stable or self-maintaining orientations: one in which the plates were in the original or closed orientation (see FIGS. 1 and 2 for the first embodiment 30 and FIGS. 5–7 for the second embodiment 30') and one in which the plates were in an open orientation.

Referring now to FIGS. 13–16, therein illustrated is a bistable third embodiment, generally designated 210 and exemplified in the context of the first embodiment hinge 10. The cylindrical or button magnets 16, 18 in the plates 12, 14 of the first embodiment hinge 10 are replaced by rectangular parallelopiped magnets 216, 218 in the plates 212, 214. It will be appreciated that the rectangular parallelopiped magnets 216, 218 are not "bar magnets" wherein the opposite poles are disposed along the longitudinal axis of the magnet, but rather akin to the aforementioned cylindrical or button magnets 16, 18 in that the polarities are defined by the upper and lower major faces of the magnets 216, 218.

The magnets 216, 218 are secured to the plates 212, 214, respectively, for movement therewith. In the closed orientation of FIGS. 13–14, the plates 212, 214 are substantially overlapping and preferably essentially superposed, as are longitudinally aligned magnets 216, 218. The magnets are in the same magnetic orientation, with the south pole (S) of one magnet 216, 218 vertically adjacent to the north pole (N) of the other magnet 218, 216. In the open orientation of FIGS. 15–16, the plates 212, 214 are reoriented such that they are at most only slightly overlapping (that is, at most only minimally superposed), and the magnets 216, 218 remain longitudinally aligned, substantially overlapping and preferably essentially superposed, but one of the magnets 216, 218 has been longitudinally inverted-that is, its longitudinal axis has been reversed or reoriented by 180°. The magnets 216, 218 remain in the same magnetic orientation as in the closed orientation.

The plates 212, 214 are easily manually manipulated, by pivoting one or both about the common hinge axis 20, between open and closed orientations, the magnets 216, 218 remaining essentially superposed and longitudinally aligned in both the open and closed orientations, although the relative longitudinal alignment is 180° reversed.

The attraction of the magnets 216, 218 is preferably sufficiently strong to maintain the plates 212, 214 in a predetermined stable relative orientation (whether open or closed), notwithstanding minor incidental vibrations (e.g., minor shaking of a user's hand while holding the compact). It is not necessary for the user to exactly superpose the plates 212, 214 in the closed orientation or to exactly place them in the open orientation; placement of the plates, 212, 214 generally in one or the other relationship will result in the magnetic forces completing the task of moving the plates to the fully closed or fully open orientation once free relative rotation of the plates is enabled (e.g., by the removal of manual restrictions).

The bistable third embodiment 210 having been expounded herein above with respect to the first embodiment hinge 10, it will be apparent that the same technique may be applied to the variant 10A thereof to obtain bistability, provided that the recess 82 is of sufficient length to accommodate the projection 80 in both stable orientations of the variant 10A. Similarly, the second embodiment hinge 30' and the variant 130 thereof may be made bistable using the same technique (preferably using magnets which are not just rectangular, but square in plan), provided that the compartment 52 in each intermediate plate 50, 150 is of sufficient diameter to allow for an 180° pivoting of any magnet extending thereinto.

Figure 19:
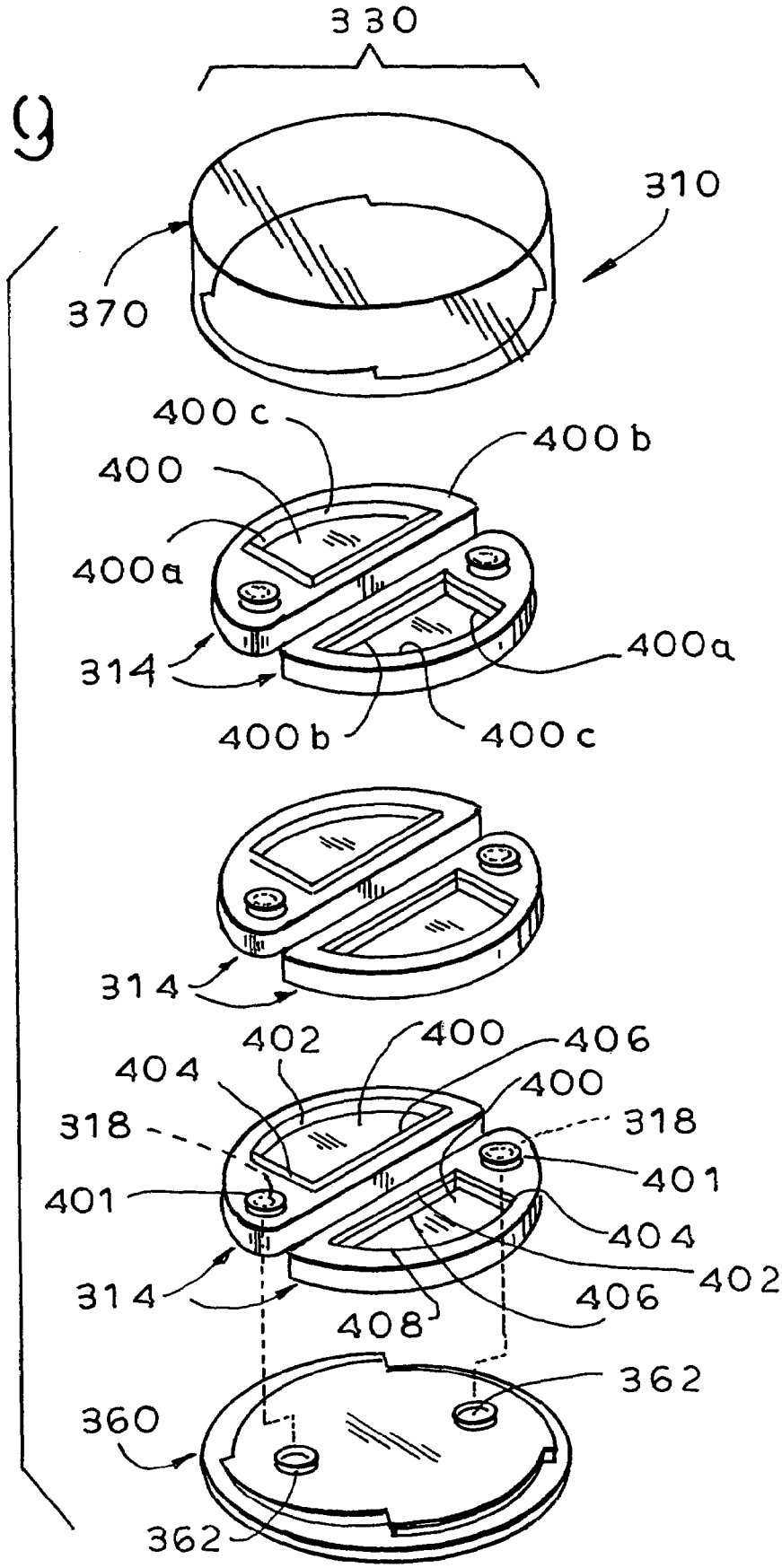
FIG. 19 is an exploded isometric view of a fourth embodiment of the present invention.

Referring now in particular to FIGS. 19–26, therein illustrated is a fourth embodiment of the present invention, generally designated 310. From a comparison of FIG. 19 showing the fourth embodiment and FIG. 11 showing a variant of the second embodiment, it will be readily apparent that many of the features are similar, if not identical. Thus, the compact 330 of the fourth embodiment 310 includes a cover, generally designated 370, identical to cover 70, and a base, generally designated 360, identical to base 60, except that upstanding non-magnetic pins 62 are replaced by magnets 362 which perform the additional function of assisting in maintenance of the immediately adjacent upper layer of plates, generally designated 314, on the base 60 by providing a magnetic attraction between the magnets 318 of the lower level of plates 314 and the magnets 362 of base 360.

Just as the variant 130 of the second embodiment compact 30' provided economic and marketing advantages over the second embodiment compact 30' due to a standardization of the two semi-cylindrical plates 112, 114, 150 on each plate level, the fourth embodiment 310 provides even further advantages of an economic and marketing nature. Not only are the two semi-cylindrical plates 314 on each plate level the same, but the plates 314 on all plate levels are the same and interchangeable. As noted before, the reduction of the number of different plates which need to be molded effects savings in the tooling and molding costs of the product. Additionally, so long as the sidewall of the cover 370 is of appropriate length, any number of levels of the plates 314 may be used between a cover 370,and a base 360.

Even more importantly from a marketing point of view, because the plates 314 are easily interchangeable, the compact 330 may be sold as a single base 360, a variety of covers 370 with sidewalls of differing heights, and a broad selection of individual plates 314. The customer selects only those plates 314 of interest. The individual plates 314 may be arrayed at the point of sale with different cosmetics, colors, tints, utensils, and the like. Even if a given pre-set compact 330 is initially purchased, the purchaser thereof may thereafter customize the purchased compact 330 by purchasing and substituting plates 314 containing the most appropriate cosmetics or utensils of interest.

Broadly speaking, it will be appreciated that the plates 314 of compact 330 are quite similar to the plates 114 of compact 130. The bottoms of the magnets 318 are slightly recessed above the bottom of the plate 314 (as are the magnets 18 in the plates 114) to define a shallow pocket 403 and the tops of the magnets 318 project slightly above the top of the plate 314 (as do the magnets 18 in the plates 114). The upwardly projecting segments of the magnets 318 are preferably covered (at the top thereof and along the exposed sides thereof) with a thin layer 401 of the plastic forming the plate 314 in order to provide a more finished appearance to the visible upper surface of the plate 314 and a sturdier system for maintaining the magnets 318 in place. Further, the recess 400 in the upper surface of each plate 314, adapted to carry a cosmetic 38 or a pan containing a cosmetic 38, defines a right angle formed by a short leg 400*a* and a long leg 400*b* (rather than the obtuse angle shown in FIG. 11) and a curved hypotenuse 400*c*.

In addition to the aforenoted production and marketing advantages of the fourth embodiment 310, the fourth embodiment 310 provides two additional features.

As noted hereinabove, with the notable exception of the bistable third embodiment requiring the use of noncircular magnets, none of the embodiments described hereinabove provides a structure (compact) which precludes movement of the plates (whether cylindrical or semi-cylindrical) to an open orientation once the cover has been removed from the compact. This presents problems in both the storage and use of the compact. For example, if the cover becomes separated from the rest of the compact during storage of the compact in a woman's handbag, accidental movement of one or more plates to the open orientation (e.g., from jostling) may result in the exposure of other articles in the handbag to powder, cream, or other cosmetics contained in the recesses of the various plates, as well as the loss of powder, utensils and the like from the compact into the handbag. By way of contrast, if the plates remain in the closed orientation, the separation of the cover from the remainder of the compact exposes only the items in the recesses of the top layer of plates, and these recesses are preferably used to contain mirrors or other non-powder products less capable of wreaking havoc in a handbag. As another example, even if the compact emerges unscathed from the woman's handbag, once the cover is removed from the rest of the compact, during use of the compact various plates in the closed orientation may by accident swing out into the open orientation and various plates intentionally placed in the open orientation may accidentally swing back into the closed orientation (even while they are in use in the open orientation).

Accordingly, the embodiments of the present invention may be provided with a pivot-impeding mechanism. While the pivot-restraining mechanism will be illustrated in connection with the fourth embodiment 310, it will be readily apparent to those skilled in the art that the pivot-impeding mechanism may also be used in connection with the other embodiments of the present invention.

As both plates 314 on a given level of the compact 330 are the same and as the plates 314 on each level are the same, the following discussion of a basic plate 314 suffices to illustrate the pivot-impeding mechanism as the bottom of the plate above is identical to the bottom of the basic plate illustrated and the top of the plate below is identical to the top of the basic plate illustrated. As best seen in FIG. 19, the plate 314 defines on its major upper surface 408, a right angle recess 400 having a short leg 400*a*, a long leg 400*b* and a curved hypotenuse 400*c*.

Referring now to FIGS. 22, 23 and 24 in particular, therein illustrated is the basic plate 314. Referring now to FIGS. 22 and 23 in particular, vertically aligned with the inner surfaces 400*a, b* & *c* of the recess 400 are three lips: a curved hypotenuse 402, a short leg 404, and a long leg 406, respectively. Each lip 402, 404, 406 extends slightly, but appreciably, above the major upper surface 408 of the plate (as best illustrated in FIG. 22).

The vertical alignment of the curved hypotenuses 400*c* and 402, the short legs 400*a* and 404, and the long legs 400*b* and 406 facilitates the manufacture of the plate and makes for an attractive appearance of the upper surface of the plate. However, it is not mandatory in any way, and the elements 402, 404, 406 projecting upwardly above the upper surface 408 may be horizontally offset from the corresponding elements of the recess 400.

Figure 25:
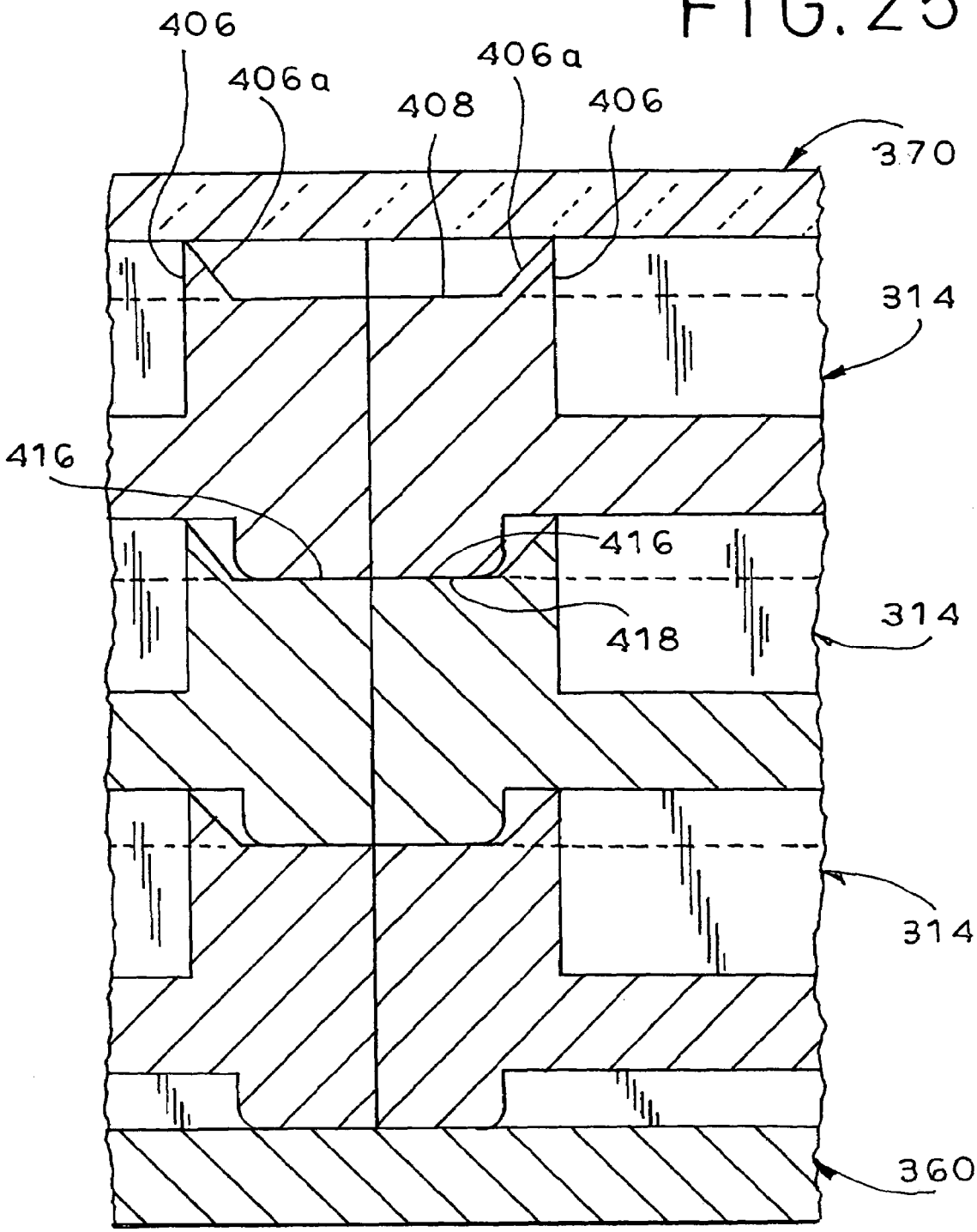
FIG. 25 is a fragmentary sectional view of the fourth embodiment, to an enlarged scale, taken along the line 25—25 of FIG. 20.
Figure 26:
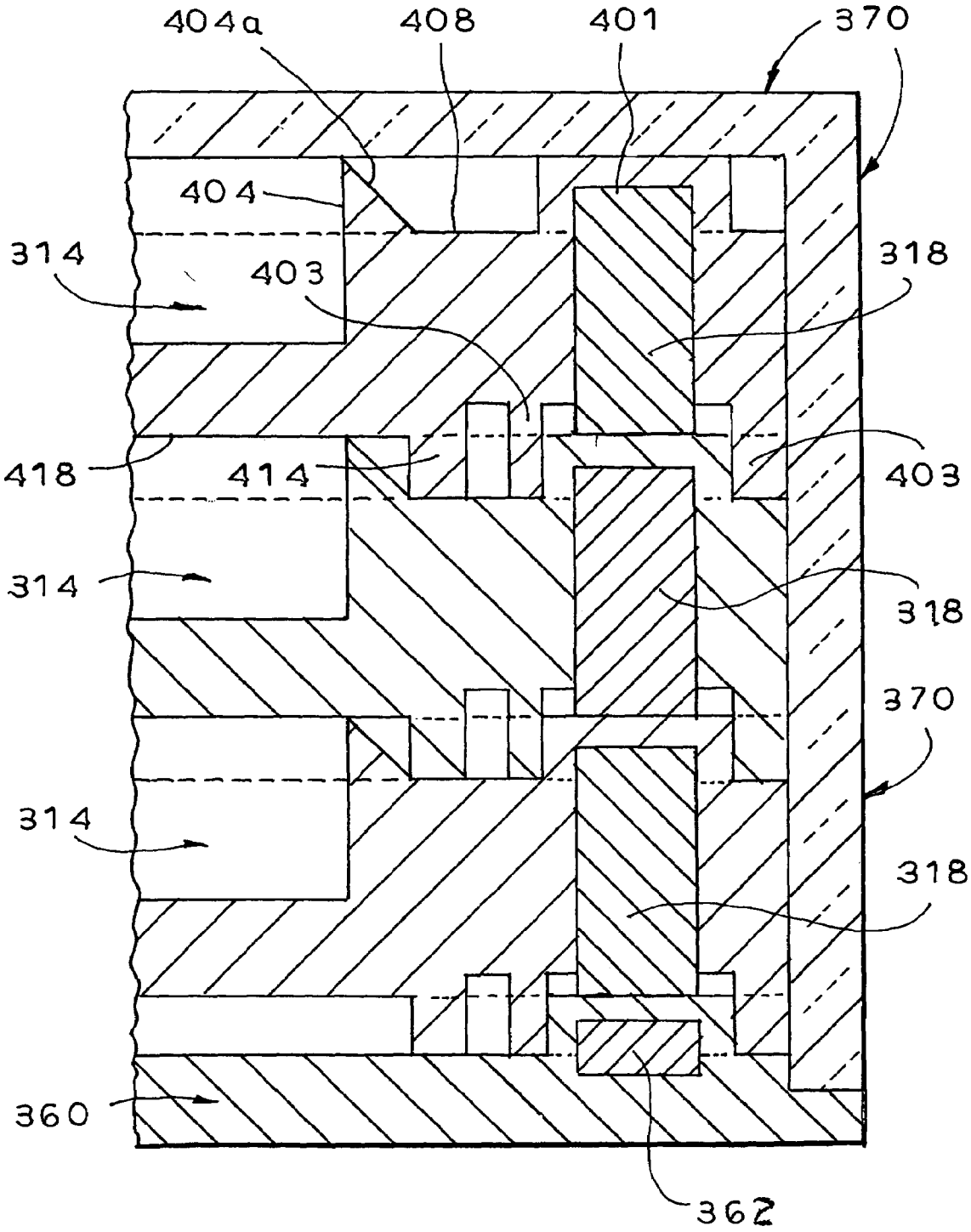
FIG. 26 is a fragmentary cross-sectional view thereof, to an enlarged scale, taken along the line 26—26 of FIG. 20.

Referring now to FIGS. 22 and 24 in particular, the bottom surface of plate 314 defines three lips: a curved hypotenuse 412, a short leg 414 and a long leg 416. Each lip 412, 414, 416 extends slightly, but appreciably, below the major bottom surface 418 of the plate (as best illustrated in FIG. 22). The downwardly projecting lips 412, 414, and 416 are preferably parallel to the respective upwardly projecting lips—namely, the curved hypotenuse 402, short leg 404 and long leg 406. It will be appreciated that the downwardly projecting lips 412, 414, 416 are not extensions of (or in vertical alignment with) the respective upwardly projecting lips 402, 404, 406, but rather are disposed outwardly thereof so that, as best illustrated in FIGS. 25 and 26, the downwardly projecting lips 412, 414, 416 of an upper plate surround the upwardly projecting lips 402, 404, 406 of a lower plate.

The lips 412, 414, 416, projecting downwardly from the major bottom surface 418 of the upper plate, define stop structures laterally engaging the lips 402, 404, 406, projecting upwardly from the major top surface 408 of the lower plate, thereby to impede relative pivotal movement of the plates in either direction. The downwardly projecting lips 412, 414, 416 are stop structures extending perpendicularly to the major bottom surface 418 of the plate. The upwardly projecting lips 402, 404, 406 are abutment structures. More particularly, the curved hypotenuse lip 402 projecting upwardly from major top surface 408 of the plate projects upwardly perpendicular thereto and terminates in a flat top 408*a*. By way of contrast, the leg lips 404 and 406 projecting upwardly from the major top surface 408 of the plate project upwardly perpendicularly thereto but define respective camming surfaces 404*a*, 406*a*. The camming surface 406*a* enables the stop structure 416 to be cammed upwardly over the abutment structure 406 as one forcibly moves the upper plate from a closed orientation toward an open orientation with a force parallel to the major top surface 408. The camming surface 404*a* enables the stop structure 414 to be cammed upwardly over the abutment structure 404 as one forcibly moves the upper plate from an open orientation towards a closed orientation with a force parallel to the major top surface 408. It will be appreciated that both camming surfaces 404*a* and 406*a* are disposed on the outer side of the respective abutment structures 404 and 406 (that is, the surfaces facing away from the recess 400). By way of contrast, the sides of abutment structure 402 do not define any camming surface.

Thus, referring now to FIGS. 27–30 in particular, as the upper plate is moved outwardly from the closed orientation to a partially open orientation, the stop structure 416 is initially cammed upwardly from its lowered (normal) orientation by camming surface 406*a* and then, once in its raised (cammed) orientation, slides over the abutment structure 406 to the line 420 illustrated in phantom line. At this point, the stop structure 416 becomes maintained in its raised (cammed) orientation primarily by resting on the top of abutment structure 404 as it moves the rest of the way from the phantom line partially open orientation of FIGS. 27–28 to the fully open orientation illustrated in FIGS. 29–30. At this point, the raised (cammed) orientation of the upper plate is lost and, under the influence of the magnets 318 of the respective plates, the upper plate returns to its lowered (normal) orientation. It will be noted that at this time the upper plate is in a stable orientation in that it cannot accidentally move back toward the closed orientation.

Figure 29:
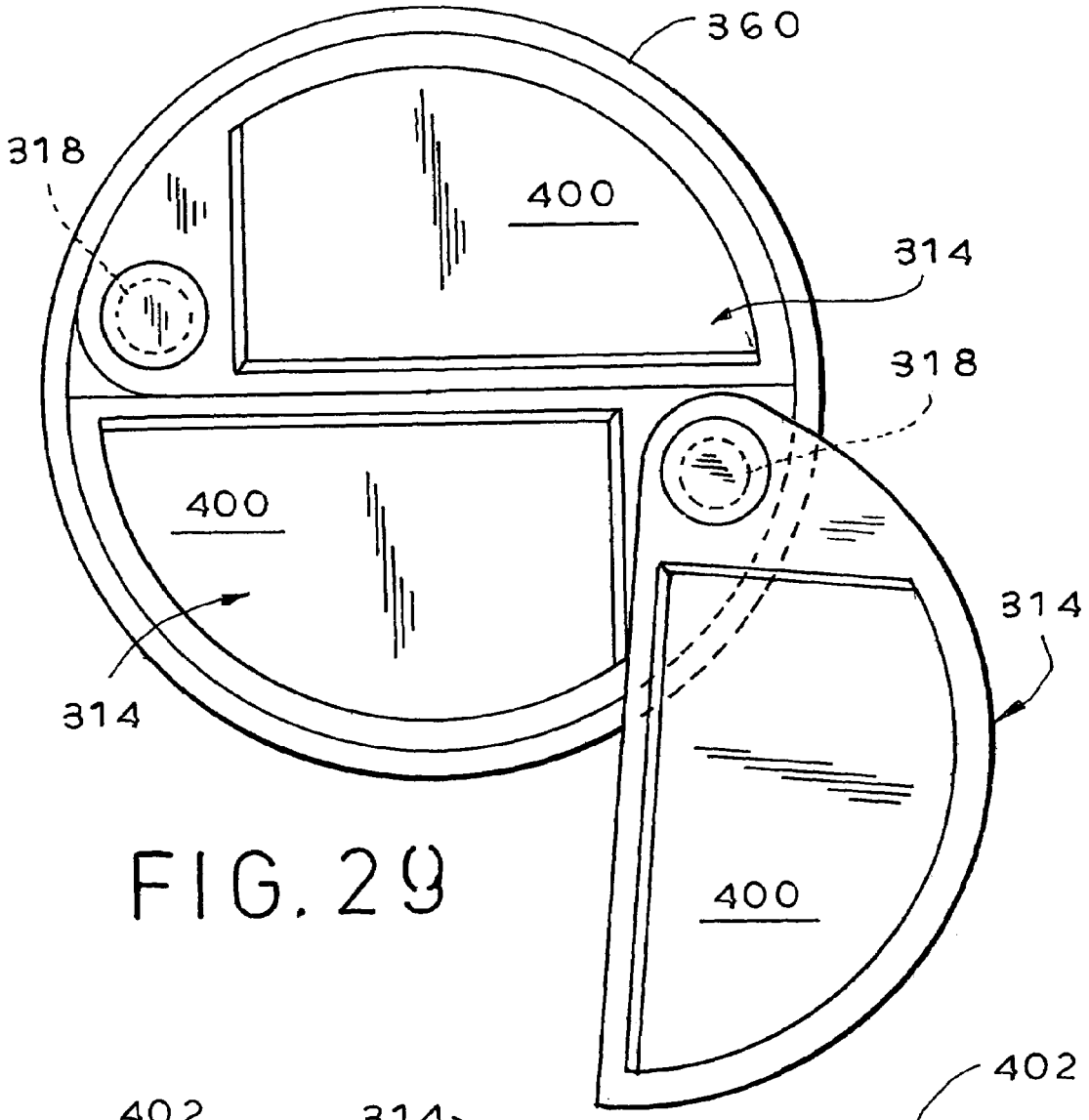
FIG. 29 is a view similar to FIG. 27, but with the one top basic piece being illustrated in a fully open orientation.

On the other hand, when the upper plate is forcibly moved from the fully open orientation of FIG. 29 towards the closed orientation, the stop structure 416 is initially cammed upwardly from its lowered (normal) orientation by the cam surface 404*a* as it contacts abutment structure 404, thereby returning the upper plate to its raised (cammed) orientation so that it can move past the abutment structures 402, and then 406, and all the way to the closed orientation, where, once again, the magnets 318 coact to force it to its lowered (normal) orientation.

While the camming surface is illustrated for pedagogic reasons as a 45° slope, clearly other angles may be used. The smaller the angle, the easier it is to effect the desired camming action. However, it is also easier for the plates accidentally to pivot relative to one another. Alternatively, the camming surfaces may be arcuate—for example, either concave or convex—so long as a force exerted in a plane perpendicular to the hinge axis is sufficient to cause relative camming of the plates.

Those skilled in the art will appreciate that, whereas in the illustrated fourth embodiment a lower plate defines an abutment structure projecting from a major top surface thereof towards an upper plate, and the upper plate defines a cooperating stop structure projecting from a major bottom surface thereof towards a lower plate, in an alternative embodiment (not shown) the abutment structure could project from a major bottom surface of an upper plate towards a lower plate and the cooperating stop structure could project from a major top surface of a lower plate towards an upper plate.

In any case, when the two plates are adjacent and in the closed orientation, the first abutment structure of one plate (here, the lower plate) impedes relative pivoting of the plates in a first direction by lateral abutment thereof with the cooperating first stop structure of the other plate (here, the upper plate). The first abutment structure and the cooperating first stop structure are cooperatively configured and dimensioned to enable forcible relative pivoting of the plates in one direction (by a force applied parallel to the plates) by one of the first abutment structure and the cooperating first stop structure being cammable over the other (i.e., moved to a raised orientation) to enable bypassing thereof. The two linear leg lips 404, 406 illustrate this feature, the long leg lip 406 impeding opening of a closed compact and the short leg lip 404 impeding closing of an open compact.

Figure 30:
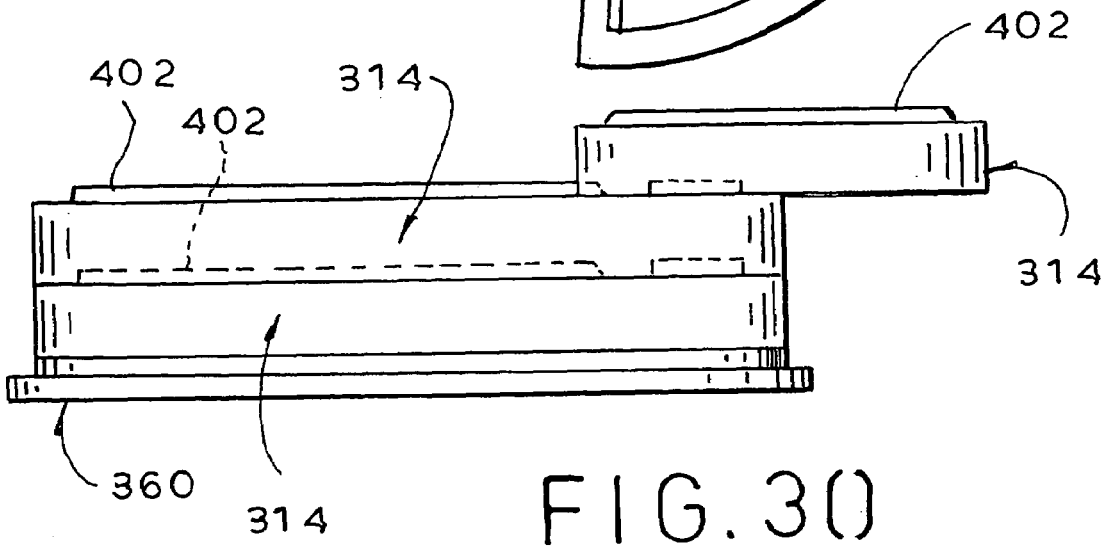
FIG. 30 is a side elevational view thereof, taken in the direction of arrow 30 of FIG. 29.
Figure 31:
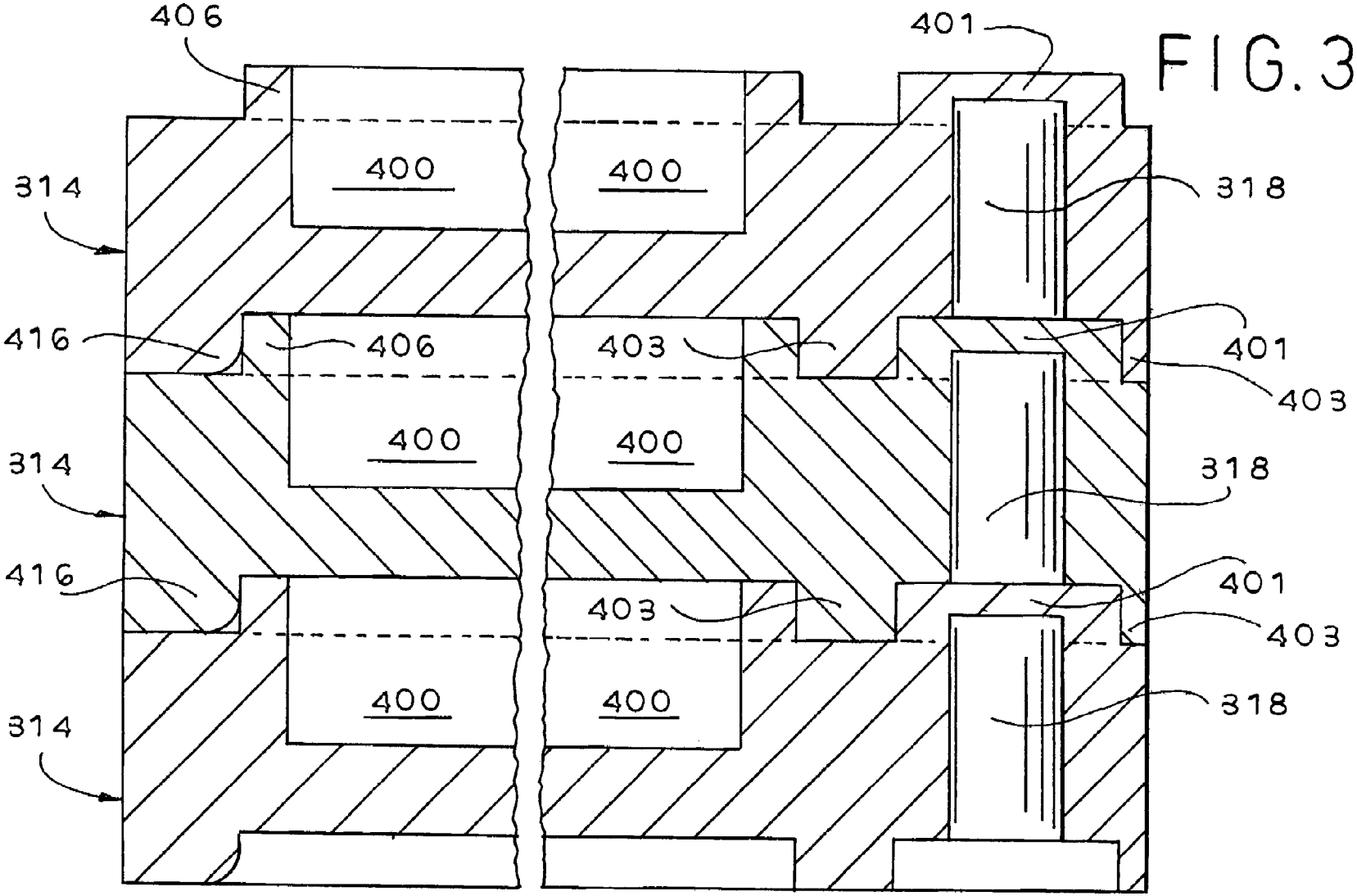
FIG. 31 is a sectional viewthereof, taken along the line 31—31 of FIG. 20.

Referring now to FIGS. 30 and 31 in particular, one plate (here, the lower plate) also defines a second abutment structure, and the other plate (here, the upper plate) also defines a cooperating second stop structure. The second abutment structure and the cooperating second stop structure are cooperatively configured and dimensioned to not only impede, but preclude forcible relative pivoting of the plates in a second direction, opposite the first direction, beyond the closed orientation. The curved hypotenuse lip 402 of a lower plate illustrates this feature by precluding relative pivoting of the plates in the second direction by abutment of the curved hypotenuse lip 402 and the stop structure of an upper plate of a closed compact.

While FIGS. 1–31 illustrate embodiments of the present invention wherein the plates 112, 114, 150, or 314 are cylindrical or semi-cylindrical, this is not a limitation on the possible configurations of the plates. Thus, FIGS. 32–47 illustrate two embodiments of the present invention wherein the plates are rectangular (actually, rectangular parallelopipeds). More particularly, FIGS. 32–37 illustrate a fifth embodiment generally designated 510 having rectangular plates and bar magnets, while FIGS. 38–47 illustrate a sixth embodiment generally designated 710 having rectangular plates and circular magnets. Other plate configurations are also possible.

Referring now in particular to FIGS. 32–37, in the illustrated bistable fifth embodiment of the present invention the compact 510 has three rectangular plates: an upper or top plate 514*a*, a middle or intermediate plate 514*b*, and a lower or bottom plate 514*c*. Clearly a lesser or greater number of plates may be used, as desired. Each of the plates 514*a*–514*c* defines a recess 600*a*–600*c*, respectively. Each of the plates 514*a*–514*c* has a generally rectangular bar magnet 518 extending parallel to the short ends. Preferably the bar magnet 518 is recessed within the respective plate, but alternatively an upper or lower surface thereof may be exposed.

The upper plate 514*a* is preferably transparent so that even the embedded bar magnet 518 therein is visible. The recess 600*a* thereof preferably bears a mirror or reflecting surface adjacent the bottom thereof so that the entire compact 510 may be used as a mirror even while in the closed orientation. In the other plates 514*b* and 514*c*, the respective recesses 600*b* and 600*c* may bear cosmetics, cosmetic utensils, and like cosmetic articles (not shown), preferably within a replaceable pan or container so that the compact 510 will retain its utility even after the cosmetic in one pan or container is used up.

Figure 32:
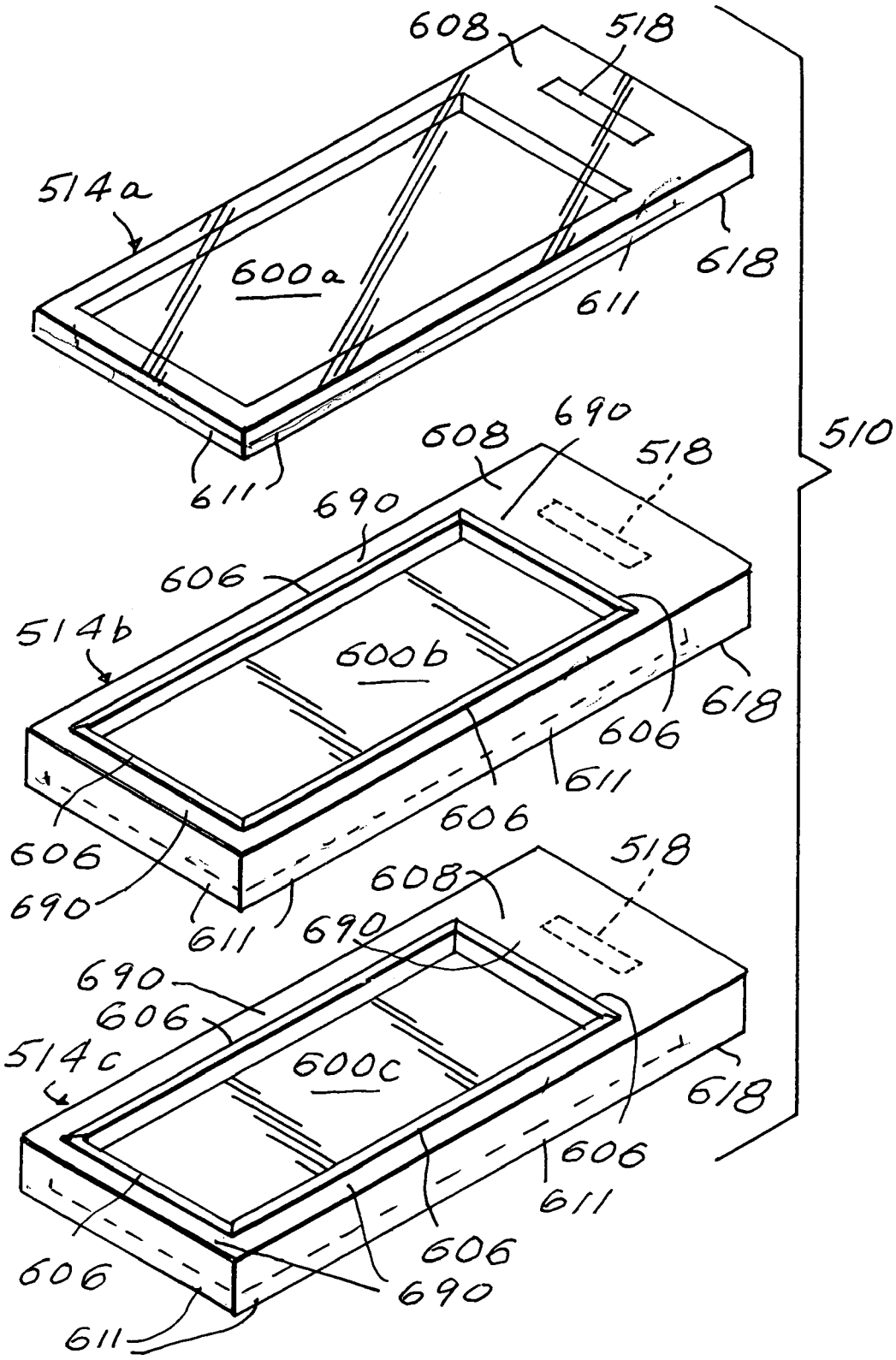
FIG. 32 is an exploded isometric view of a fifth embodiment of the present invention.
Figure 34:
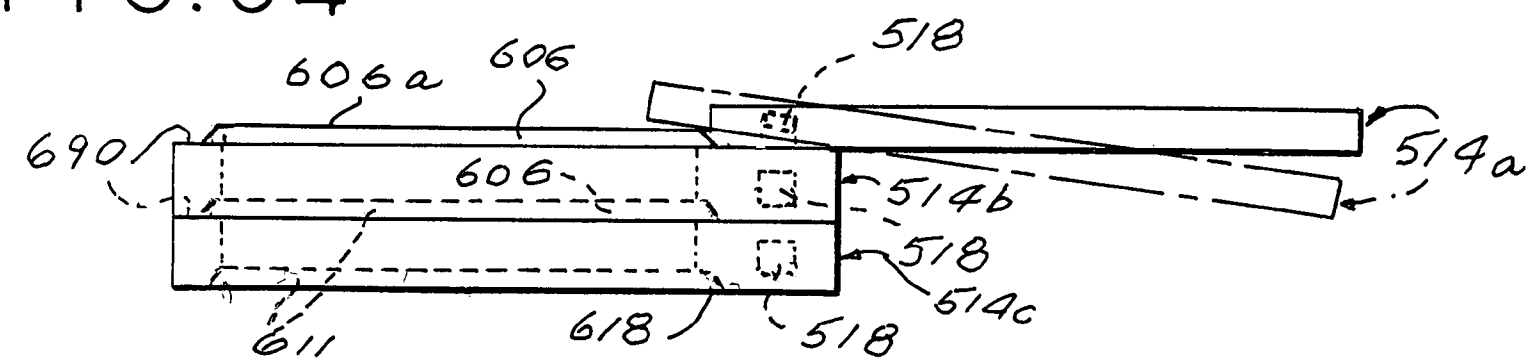
FIG. 34 is a side elevation view thereof, taken in the direction of arrow 34 of FIG. 33.
Figure 35:
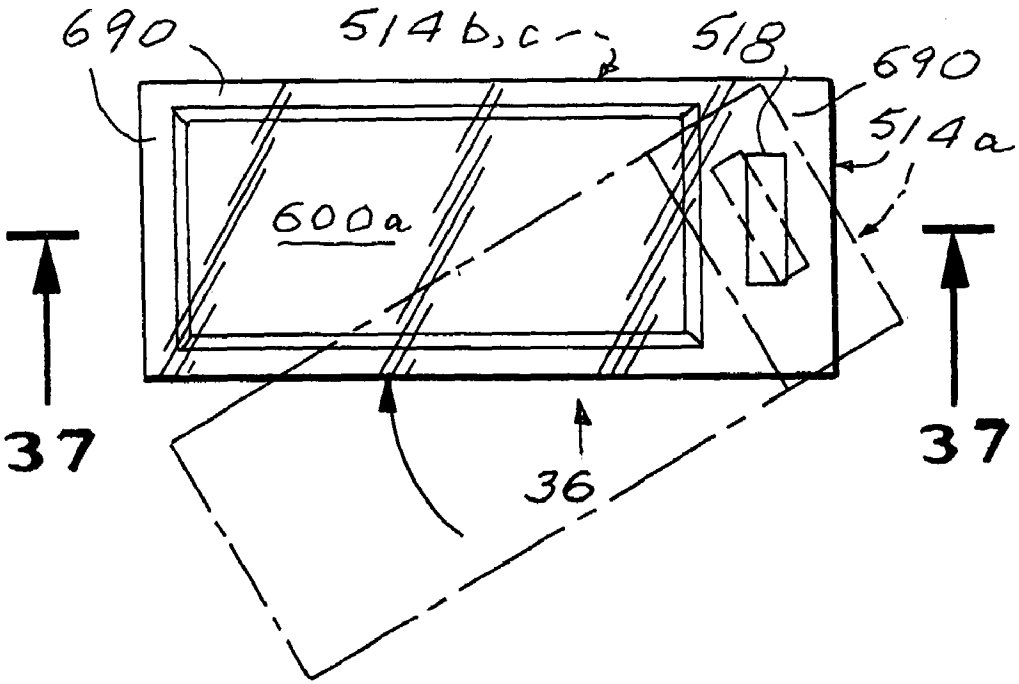
FIG. 35 is a top plan view thereof in a closed orientation, with the upper plate being illustrated in phantom line in a partially closed orientation.
Figure 36:
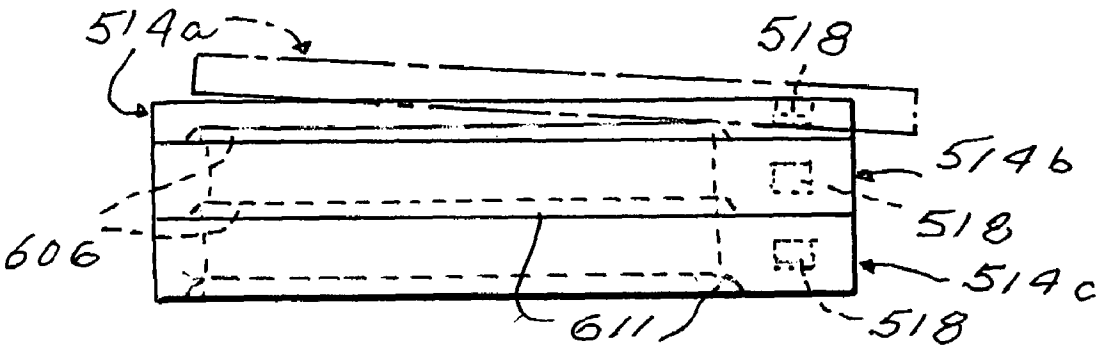
FIG. 36 is a side elevational view thereof, taken in the direction of arrow 36 of FIG. 35.

While the vertically aligned bar magnets 518 of the three plates will tend to keep the three plates in the open or closed orientation by themselves, a non-magnetic pivot-impeding mechanism is also provided. To this end, as best seen in FIG. 32, the upper surface 608 of each of the upper and lower plates 514*b* and 514*c* defines four lips 606 vertically aligned with the inner surfaces of the recesses 600*b* and 600*c*, respectively. Each of the four lips 606 extends slightly, but appreciably, above the major upper surface 608 of the plate, as best seen in FIGS. 34 and 36. The upwardly projecting lips 606 are spaced inwardly from the peripheral outer edges of the plate 514*b*, 514C by a peripheral margin 690. As in the case of the fourth embodiment 310, the vertical alignment of the upwardly projecting lips 606 and the inner sides of the recesses facilitates manufacture and makes for an attractive appearance, but is not in any way mandatory; accordingly, the upwardly projecting lips 606 may be horizontally offset from the sides of the recesses.

Figure 37:
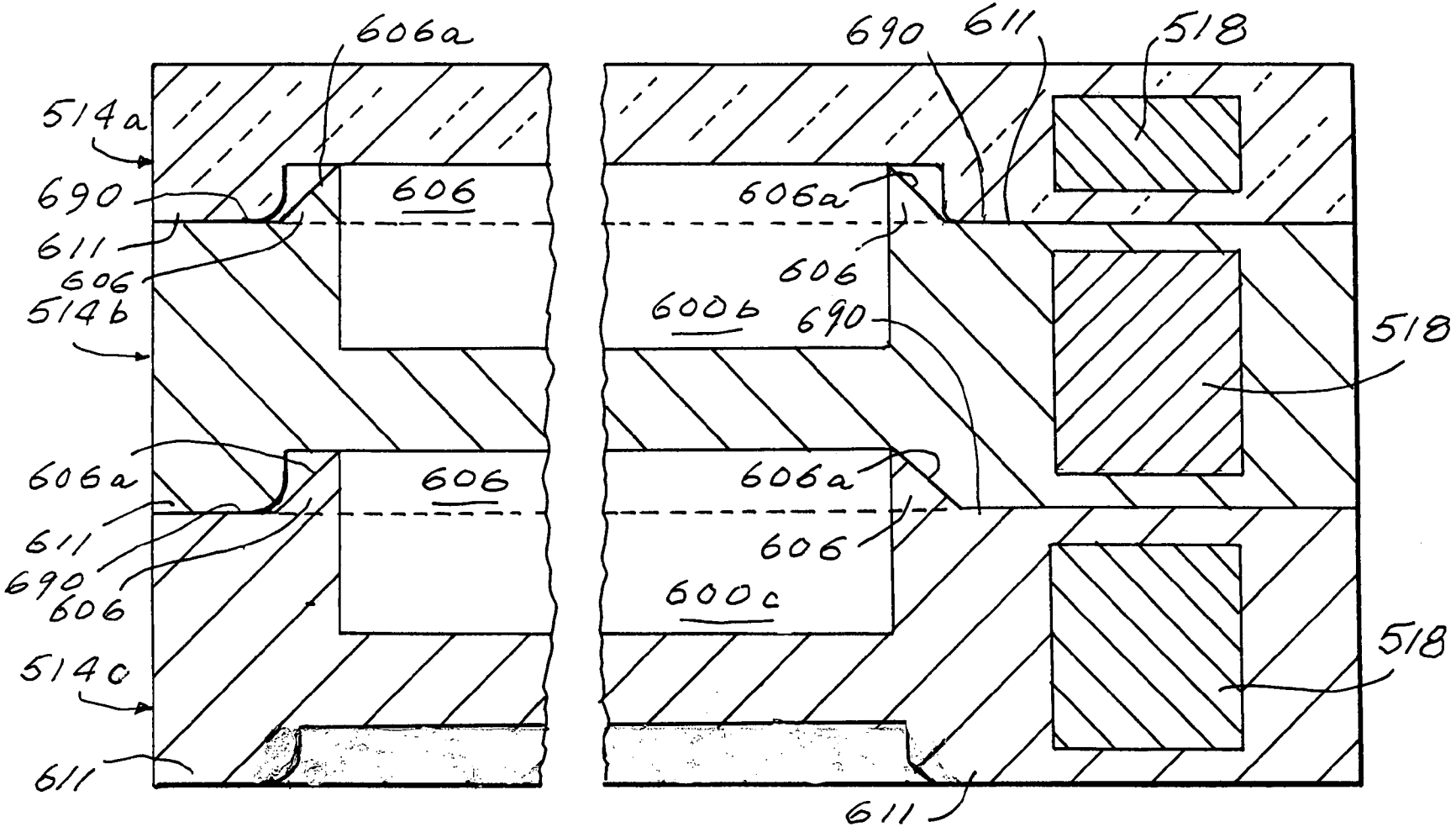
FIG. 37 is a sectional view, to an enlarged scale, taken along the line 37—37 of FIG. 35.

The bottom surface of the upper plate 514*a* and middle plate 514*b* define rectangular marginal or peripheral lips 611. The marginal lips 611 extend slightly, but appreciably, below the major bottom surface 618 of the plate (as best illustrated in FIG. 37). While each of the downwardly projecting marginal lips 611 is preferably parallel to the respectively upwardly projecting lips 606, it will be appreciated that the downwardly projecting marginal lips 611 are not an extension of, or in vertical alignment with, the respective upwardly projecting lips 606, but rather are disposed outwardly thereof so that the downwardly projecting marginal lips 611 of an upper plate 514*a*, 514*b* surround the upwardly projecting lips 606 of the next lower plate 514*b*, 514*c*. The marginal lips 611 may be truly marginal and extend downwardly from each respective side of the plate (not shown), or only three lips 611 may be truly marginal and the fourth marginal lip 611 adjacent the magnet 518 may be disposed intermediate the magnet 518 and the adjacent side of the recess (as illustrated in FIG. 32).

The marginal lips 611 projecting downwardly from the bottom surface 618 of a plate preferably rest on peripheral margins 690 of an adjacent lower plate and define stop structures for laterally engaging the upwardly projecting lips 606 of the adjacent lower plate, thereby to impede relative pivotal or orthogonal movement of the two plates. Each of the lips 606 projecting upwardly from the top surface 608 of a plate defines an abutment having a respective camming surface 606*a* (best illustrated in FIG. 37). The camming surfaces 606*a* enable the downwardly projecting marginal lips 611 to be cammed upwardly from peripheral margins 690 and over the upwardly projecting lips 606 as one forcibly moves an upper plate from a closed orientation towards an open orientation or from an open orientation to a closed orientation, with a force parallel to the planes of the plates.

Unlike the fourth embodiment 310, the fifth embodiment 510 is devoid of any upwardly projecting lip (like lips 404 and 406 of the fourth embodiment 310) which projects upwardly perpendicular to the top surface 608 of the plate and acts as an abutment which not only impedes but also precludes relative passage thereby of the adjacent upper plate under the influence of a force parallel to the top surface of the plate (e.g., the planes of the plates). In other words, the pivot-impeding mechanism cooperates with the bar magnets 518 to bias the compact 510 to remain in a closed orientation, thereby to prevent accidental opening thereof, but does not limit forcible relative opening thereof.

Figure 33:
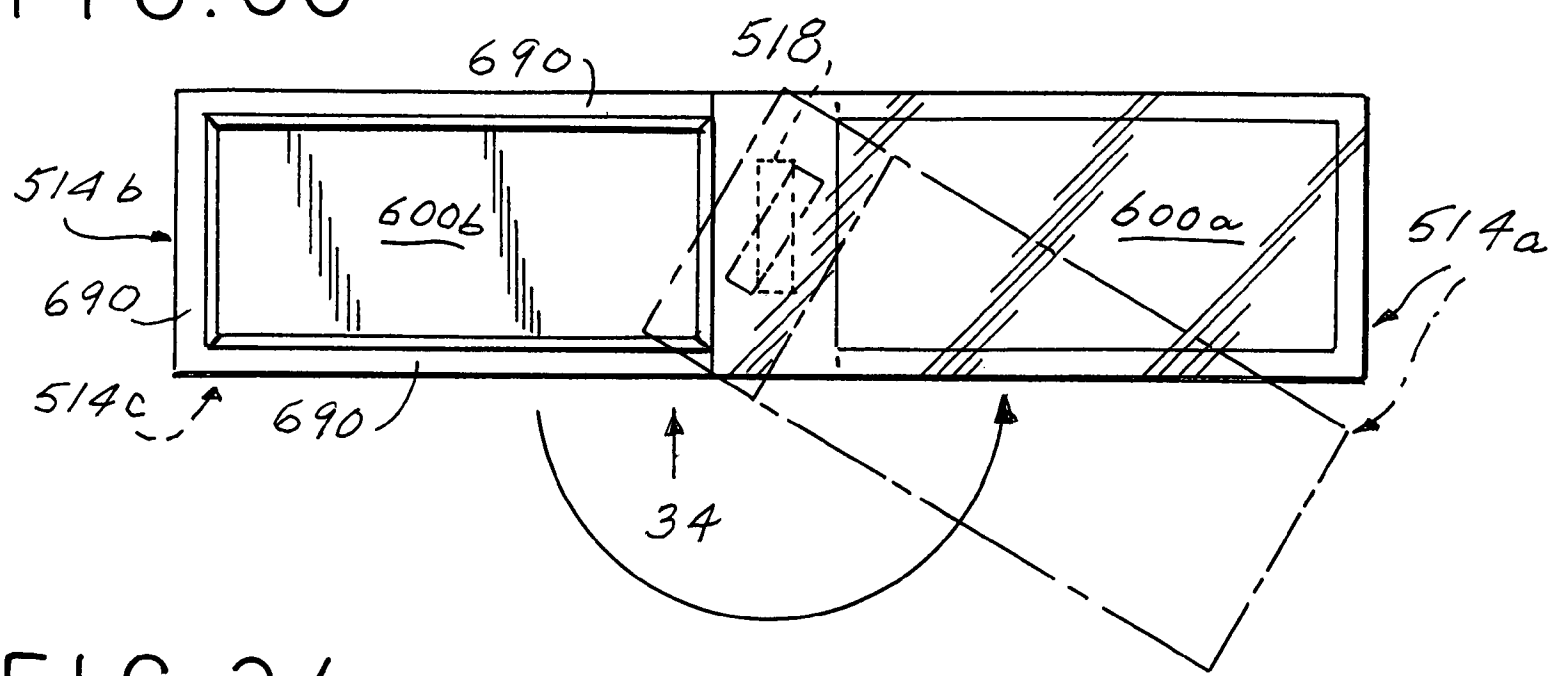
FIG. 33 is a top plan view thereof in an open orientation, the upper plate being illustrated in phantom line in a partially open orientation.

It will be appreciated that, as the cosmetic case 510 has its upper plate 514*a* moved from its stable closed orientation to its stable open orientation (illustrated in solid line in FIGS. 33 and 34), by movement in the direction of the arrow of FIG. 33, it will pass through a non-stable intermediate orientation (illustrated in phantom line in FIGS. 33 and 34). Similarly, when the upper plate 514*a* is moved from its stable open orientation to its stable closed orientation (illustrated in solid line in FIGS. 35 and 36), by movement in the direction of the arrow of FIG. 35, it will pass through a non-stable intermediate orientation (illustrated in phantom line in FIGS. 35 and 36). In both of these unstable intermediate positions of the compact 510, the plane of upper plate 514*a* is slightly non-parallel to the plane of plate 514*b* immediately below (as shown, tilted downwardly at its free end relative to intermediate plate 514*b*) due to the interaction of the upwardly projecting lips 606, the downwardly projecting marginal lips 611, and the magnets 518 drawing the plates 514*a* and 514*b* together (as best seen in FIGS. 34 and 36).

While opening and closing of the fifth embodiment 510 has been illustrated in FIGS. 32–36 only with regard to movement of an upper plate 514*a* relative to the intermediate plate 514*b*, it will be appreciated by those skilled in the art that similar effects are produced by movement of the central plate 514*b* (either alone or in combination with the upper plate 514*a*) as it is moved relative to the lower plate 514*c*.

The recess 600*a* of the upper plate 514*a* may be devoid of upwardly projecting lips 606, and the lower plate 514*c* may be devoid of the downwardly projecting marginal lips 611. Both would be non-functional, and a relatively smooth top and bottom surface provide the desirable aesthetic feature of external smoothness for the compact 510.

While the compact 510 is illustrated as having only three plates 514*a*–*c*, there may be fewer or more, as desired, provided only that the addition of a plate above plate 514*a* requires the addition of upwardly projecting lips 606 on the top surface 608 about the recess 600*a* on the top surface 608 of plate 514*a*, and the addition of a plate below plate 514*c* requires the addition of downwardly projecting marginal lips 611 on the bottom surface 618 of plate 514*c*, should such lips 601, 611 otherwise be absent.

Referring now in particular to FIGS. 38–47, therein illustrated is the sixth embodiment 710 of a compact according to the present invention. Whereas in the fifth embodiment 510 described immediately hereinabove, the pivot-restraining mechanism was intended merely to minimize accidental opening of the compact—whether it be by swiveling, longitudinal or transverse forces—while still permitting forcible opening thereof by forcible relative swiveling in either direction, in the sixth embodiment 710 the pivot-restraining mechanism serves two functions. First, it is intended to preclude even forcible opening of the compact by swiveling of the upper plate 714*a* relative to the central plate 714*b* in one direction, while allowing forcible opening by swiveling in the opposite direction. Second, it is intended to preclude swiveling of the intermediate plate 714*b* relative to the lower plate 714*c* by forcible relative swiveling in either direction unless the swiveling is preceded by or accompanied by a vertical partially separating force. The rationale for these differences arises out of differences in the position and contents of the recesses 800*a, b* and *c* of the three plates 714*a, b* and *c*, respectively. It will be appreciated that such close control of the opening process entails a loss in modularity of the plates 714*b*, 714*c* (i.e., their exchangeability with one another).

The upper plate 714*a* is not transparent (like the upper plate 514*a* of the fifth embodiment 510), but defines a central recess 800*a* containing a mirror or like reflective surface, generally designated M.

Figure 38:
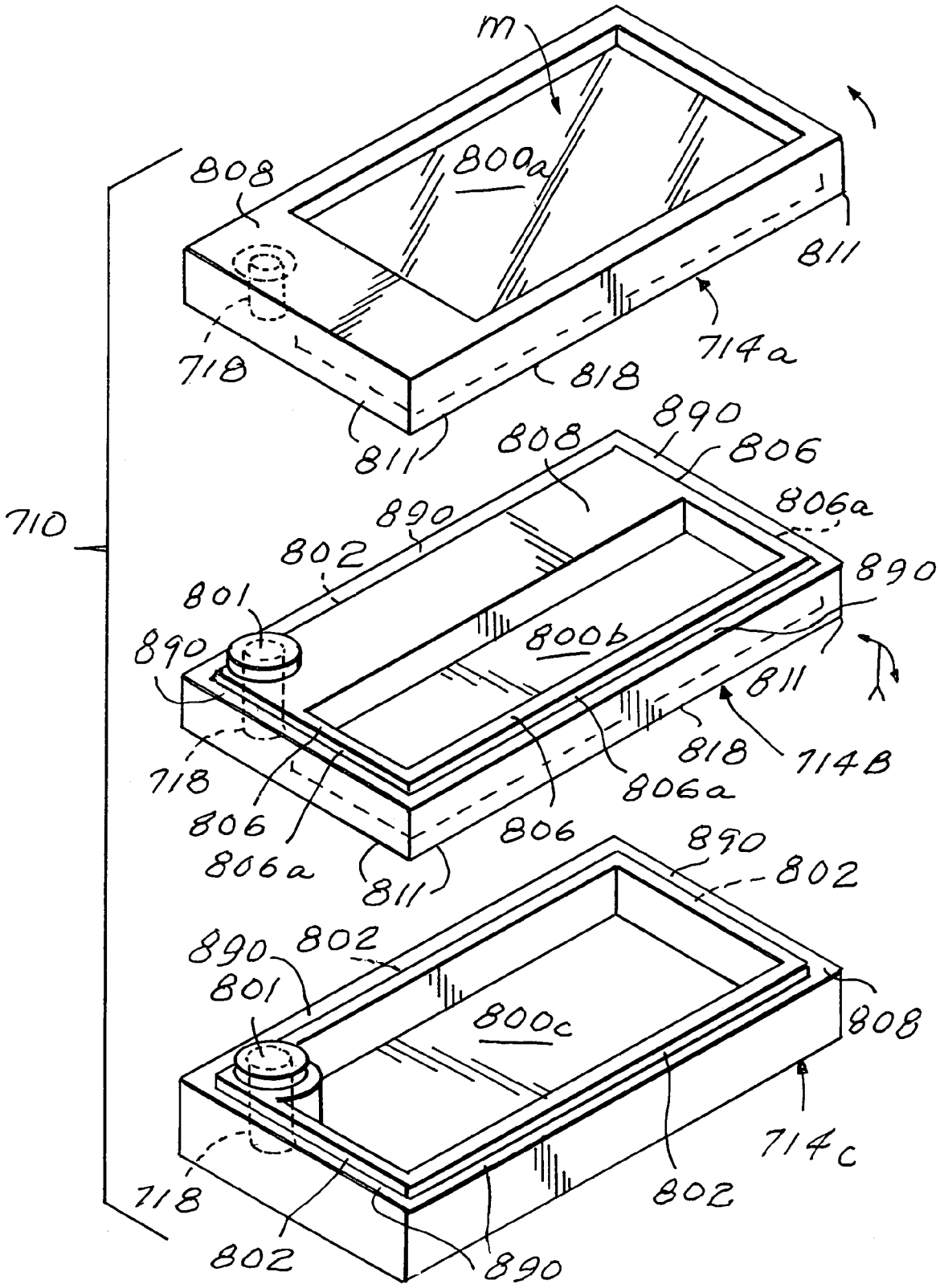
FIG. 38 is an exploded isometric view of the sixth embodiment.
Figure 42:
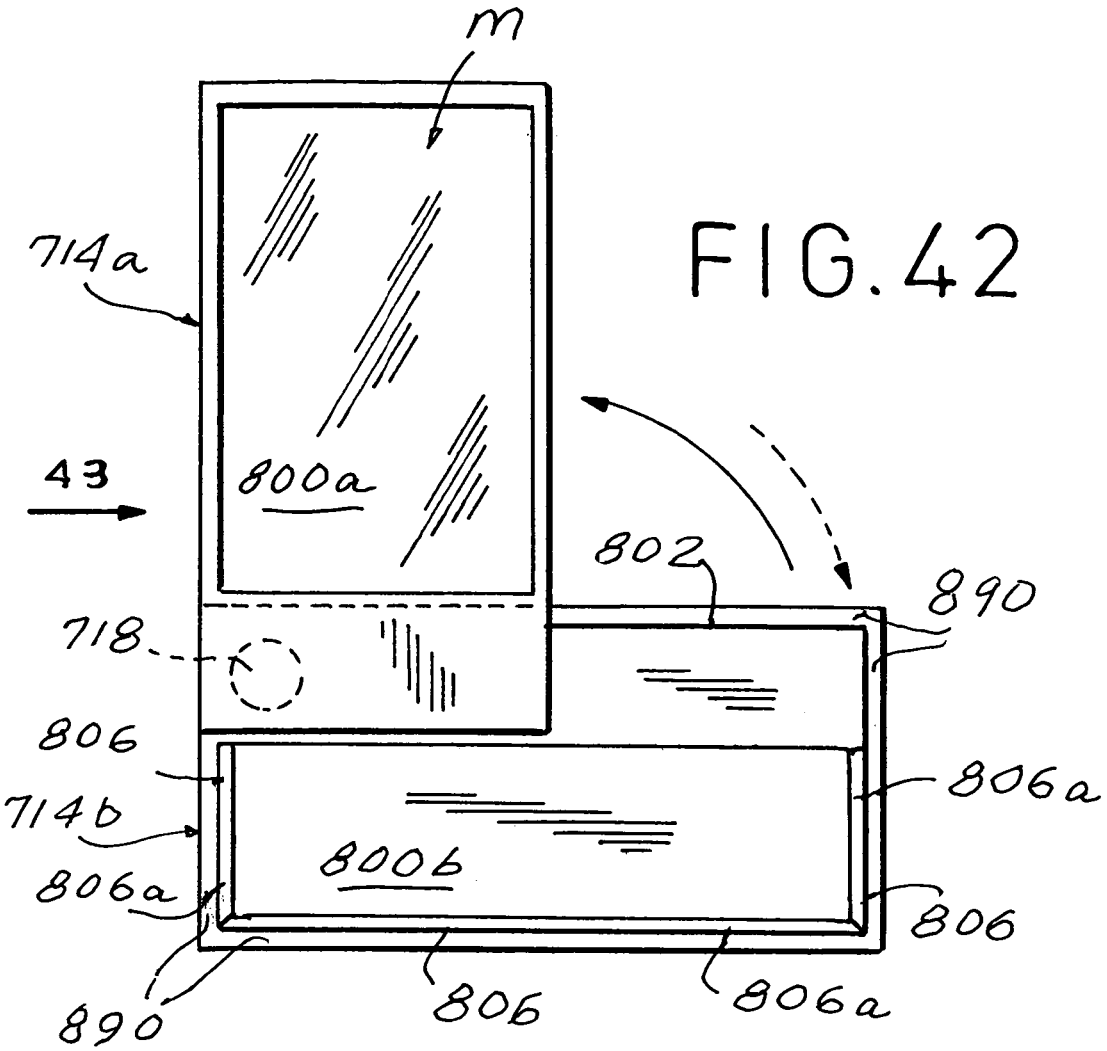
FIG. 42 is a top plan view thereof with the upper plate in a stable open orientation.

The intermediate or central plate 714*b* defines a recess 800*b* for carrying a cosmetic. The recess 800*b* is not centrally situated on the plate 714*b*, but rather disposed more to one side thereof, as best seen in FIGS. 38 and 42. Accordingly, the long lip 806 adjacent recess 800*b* as well as the short end lips 806 have an angled surface 806*a* (best illustrated in FIGS. 46 and 47) which permits rotation or swiveling of the upper plate 714*a* relative to the intermediate plate 714*b* only in such a manner as to first reveal the recess 800*b* and its contents rather than the other side of intermediate plate 714*b* which does not contain the recess 800*b*. On the other hand, the other long side of intermediate plate 714*b* defines an upwardly projecting lip 802 which does not have an angled outer surface. In other words, while the upwardly and inwardly angled outer surfaces 806*a* on three lips 806 enable forcible rotation of the upper plate 714*a* relative to the central plate 714*b* notwithstanding the downwardly projecting marginal lips 811 resting on marginal recesses 890 of intermediate plate 714*b* (as illustrated by the arrow associated with upper plate 714*a*), the orthogonal outer surface of upwardly projecting lip 802 precludes even forcible rotation of the upper plate 714*a* relative to the central plate 714*b* in the opposite direction due to its blocking engagement with a marginal lip 811 projecting downwardly from the lower surface 818 of upper plate 714*a* onto marginal recess 890 of the central plate 714*b*.

The lower plate 714*c*, which may be deeper than the upper and intermediate plate 714*a*, 714*b*, has a recess 800*c* intended to receive cosmetic utensils such as brushes and other cosmetic applicators (not shown). As these brushes and other cosmetic applicators can more easily fall out of the recess 800*c* than can the packed cosmetics of recess 800*b*, in embodiment 710 the recess 800*c* of lower plate 714*c* cannot be opened and exposed by a simple lateral forcible movement or swiveling of the intermediate plate 714*b* relative to lower plate 714C. Instead, lower plate 714*c* defines an upwardly projecting lip 802 which forms a rectangle extending above the recess 800*c*. Any attempt to move the intermediate plate 714*b* relative to the bottom plate 714*c* is blocked by the engagement of at least one of the upwardly projecting lips 802 of lower plate 714*c* against at least one of the downwardly projecting marginal lips 811 of intermediate plate 714*b*.

Figure 43:
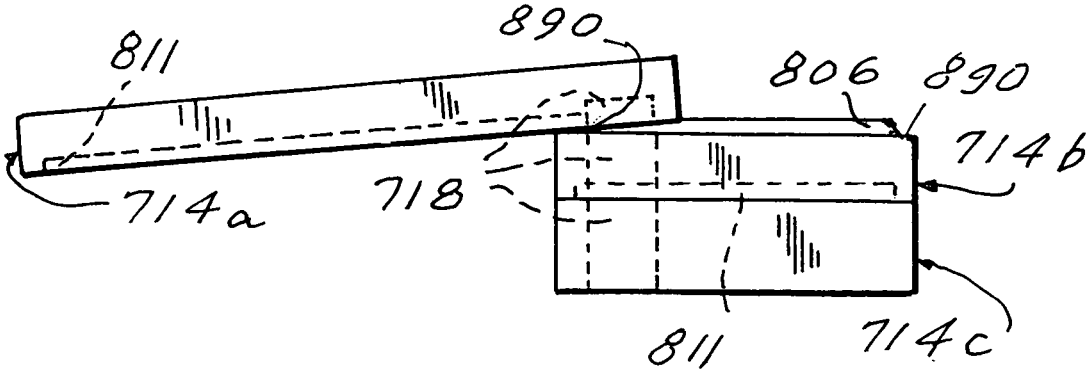
FIG. 43 is a side elevational view thereof, taken in the direction of arrow 43 of FIG. 42.
Figure 44:
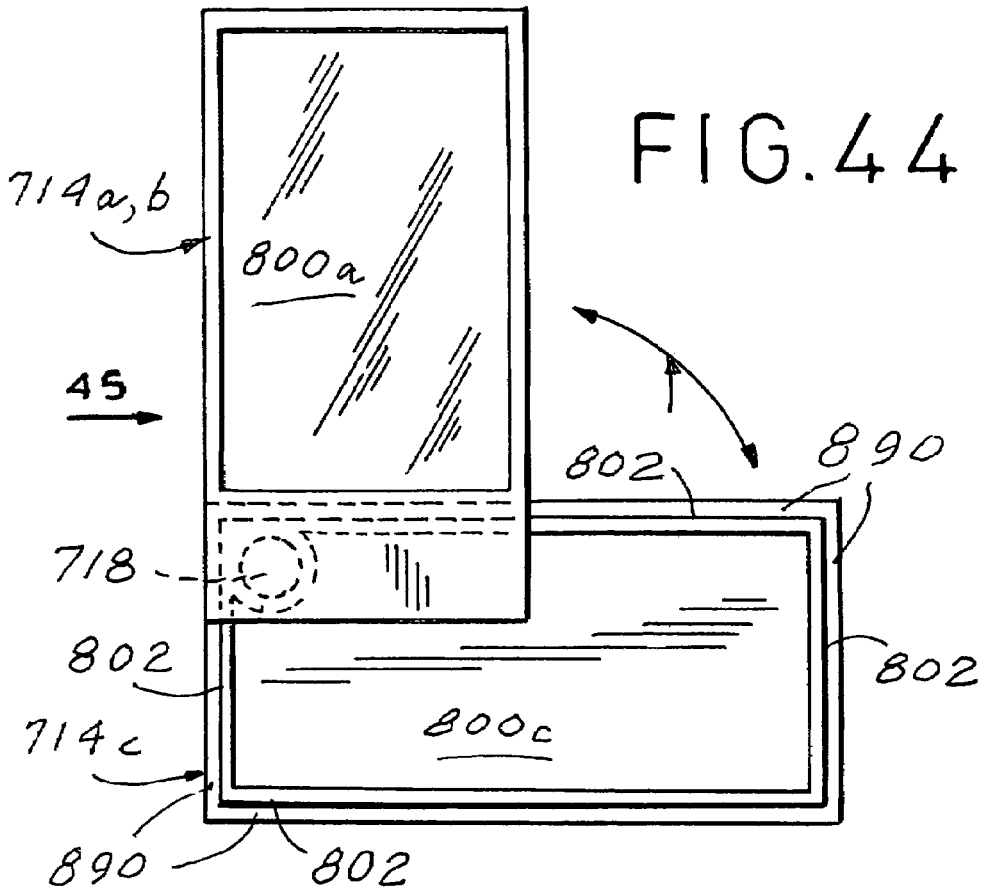
FIG. 44 is a top plan view thereof with the upper and intermediate plates in a open orientation relative to the lower plate.
Figure 45:
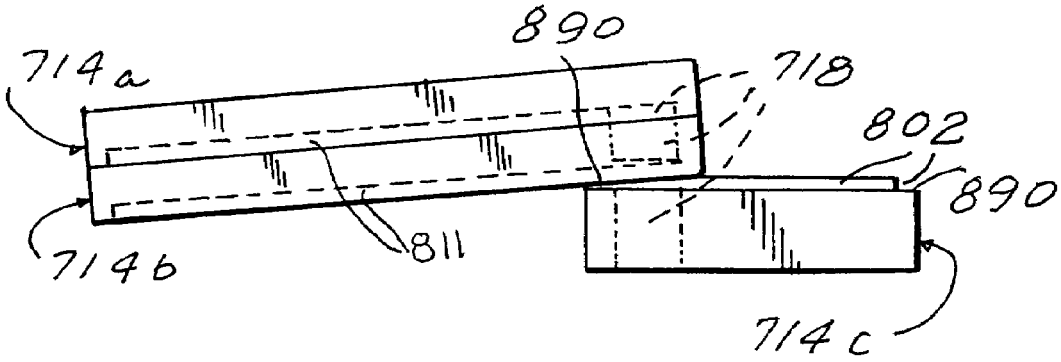
FIG. 45 is an end elevational view thereof, taken in the direction of arrow 45 of FIG. 44.
Figure 46:
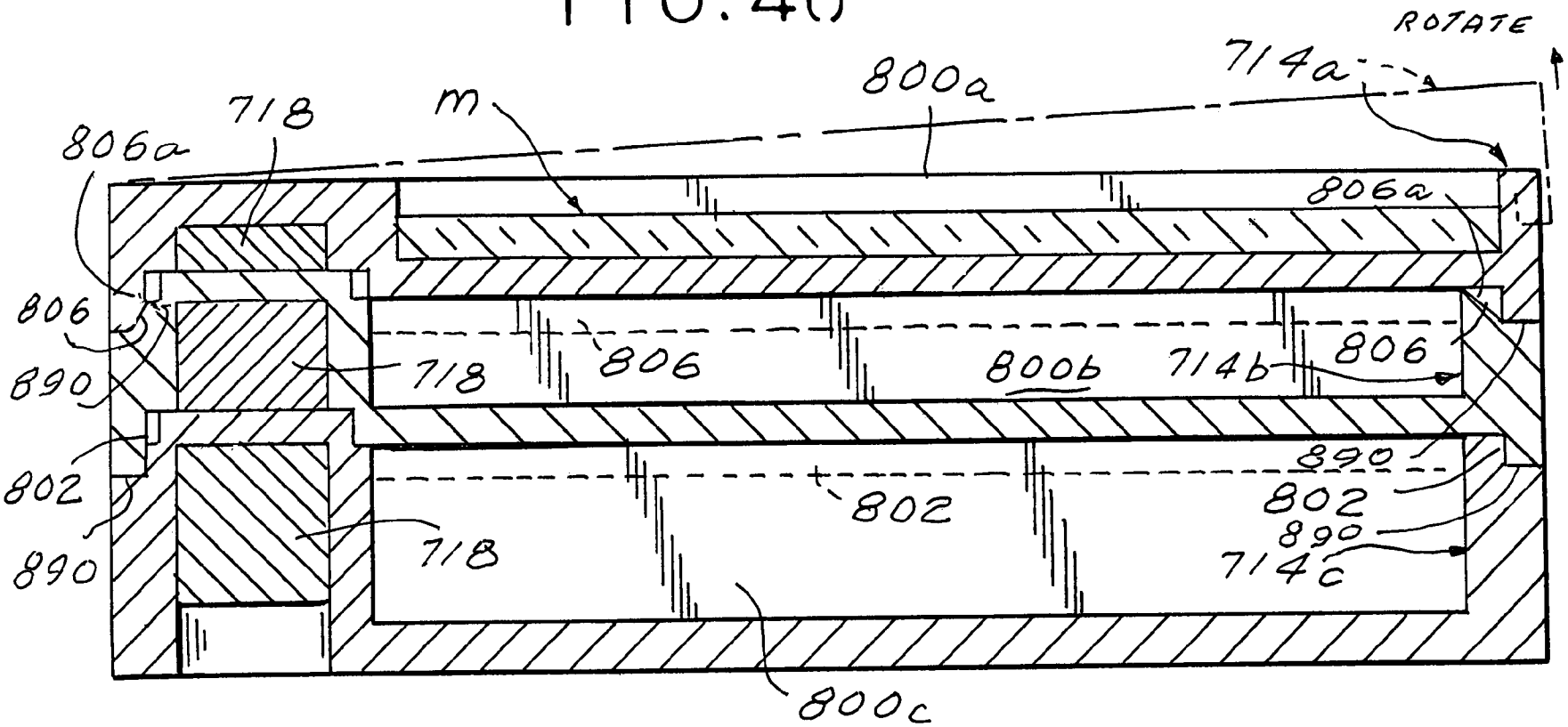
FIG. 46 is a sectional view thereof, to an enlarged scale taken along the line 46—46 of FIG. 39, with the upper plate being illustrated in phantom line in a raised orientation ready for rotation.

FIGS. 42 and 43 illustrate opening and closing of the recess 800*b* of intermediate plate 7146 by relative movement of the upper plate 714*a* and the intermediate plate 714*b*, while FIGS. 44 and 45 show opening and closing of the recess 800*c* of lower plate 714*c* by movement of plates 714*a* and 714*b* as a unit relative to lower plate 714*c*.

In order to open the recess 800*c*, the free end of intermediate plate 714*b* (remote from the magnet 718) must be slightly lifted to enable the downwardly projecting lips 811 of intermediate plates 7146 to clear the upwardly projecting lips 802 of lower plate 714*c*. This two-part motion—first the vertical motion, then the horizontal motion—is indicated by the triple-headed arrow associated with intermediate plate 714*b*.

To close the recess 800*c* of lower plate 714*c* once it has been opened, a simple swiveling of the plates 714*b* is sufficient since at least one of the downwardly projecting marginal lips 811 of the intermediate plate 714*b* is already atop at least one of the upwardly projecting lips 802 of the lower plate 714*c* so that no further vertical motion is necessary.

Each of the rectangular parallelepiped plates 714*a*, 714*b*, 714*c* contains a bipolar cylindrical or circular magnet 718. The magnets 718 are vertically aligned, with the tops of the magnets 718 of the lower and intermediate plates 714*c* and 714*b* having a plastic covering 801 which is received within an appropriate circular bottom-opening recess in the lower surface 818 of the immediately higher plate. This interengagement of the magnet covers 801 and the recesses in the lower surfaces 818 of the immediately higher plates limits non-swiveling motion of the plates relative to one another (that is, precludes relative orthogonal movement of the plates) while still enabling intentional separation of the plates along the vertical axis of alignment of the magnets 718.

Figure 47:
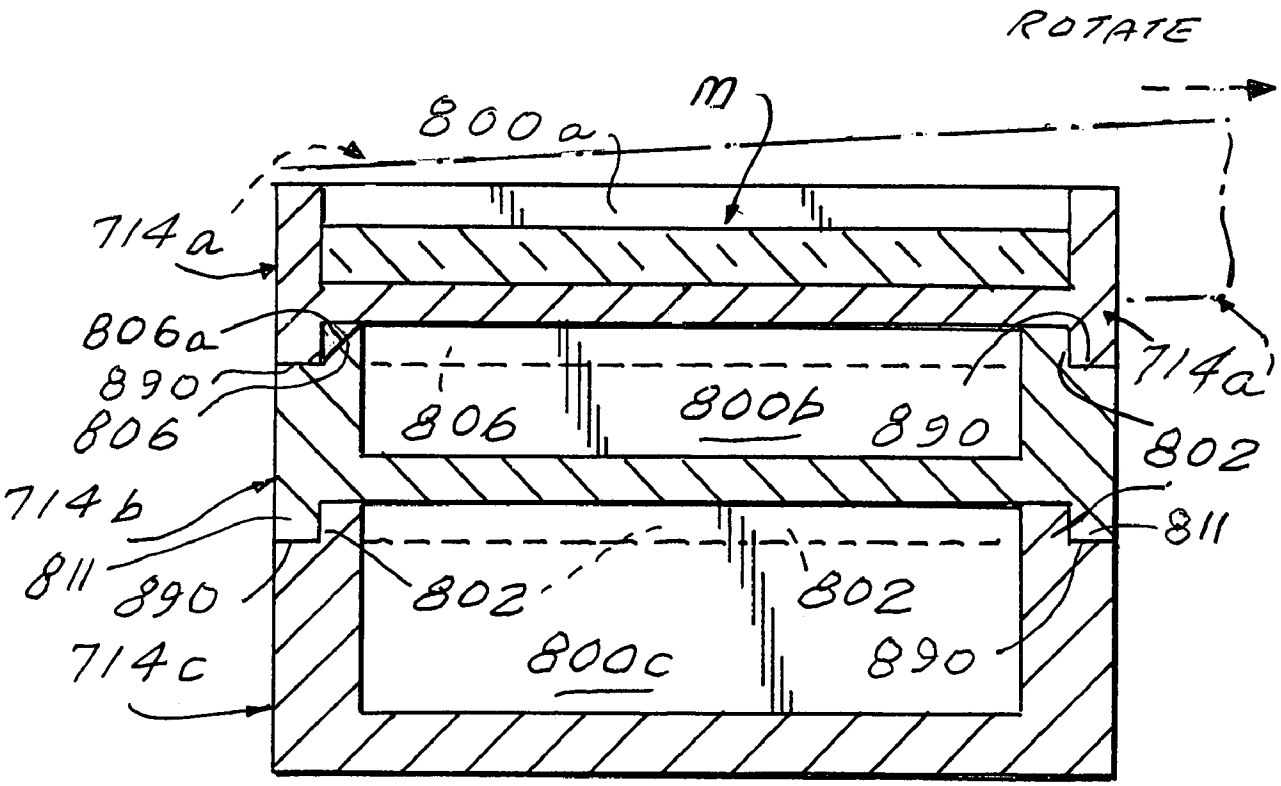
FIG. 47 is a sectional view, to an enlarged scale, taken along the line 47—47 of FIG. 39 with the upper plate being illustrated in phantom line in a raised orientation ready for rotation and as rotated.

When the upper plate 714*a* is in the open orientation relative to the intermediate plate 714*b* (as shown in FIGS. 42 and 43) or when the upper and intermediate plates 714*a*, 714*b* as a unit are in the fully open orientation relative to the lower plate 714*c* (as shown in FIGS. 44 and 45), the magnetic attraction between magnets 718 (acting to pull the various plates together) forces the upper plate 714*a* or the upper and intermediate plates 714*a*, 714*b* as a unit to tilt downwardly at their free ends. The downward tilt in the fully open orientation results from the existence of the peripheral margin 890 between the outer surface of upwardly projecting lips 802 of intermediate plate 714*b* or lower plate 714*c* and the adjacent outer edge of that plate. (For the purposes of exposition, the angle of tilt is somewhat exaggerated in FIG. 45.) On the other hand, after the upper plate 714*a* or the upper and intermediate plates 714*a*, 714*b* as a unit leave the closed orientation and before they enter the open orientation, the swivelled plates pass through an intermediate orientation wherein they tilt upwardly at the free ends thereof (i.e., they are inclined at an upward tilt relative to the planes of the other plates) as illustrated in FIG. 47 in phantom line. (Again, for expository purposes, the angle of inclination is somewhat exaggerated in FIG. 47.) The upward tilt in these intermediate orientations results from the interaction of the magnetic forces exerted by the magnets 718 (acting to pull the various plates together) and the interaction of the downwardly extending lips 811 and the upwardly extending lips 802, 806.

The fifth and sixth embodiments 510, 710 illustrate that the pivot-restraining mechanism may be used in order to prevent accidental opening of a recess, to enable forcible opening of a recess from either side, to enable forcible opening of a recess from one side but not the other side, and to preclude even forcible opening of a recess unless it is accompanied by a manual vertical separation between the plate containing the recess and the plate immediately above.

To summarize, the current invention provides a magnetic hinge characterized in one embodiment by a virtual hinge axis. The hinge has no hinge pin either to increase the physical dimensions of the hinge or occupy space at the immediate hinge plates. The hinge plates are readily manually separable to deconstruct the hinge and readily manually joinable to reconstitute the hinge. Various devices may profitably incorporate such a hinge.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A magnetic hinge defining a hinge axis, comprising:

(A) a first hinge plate of non-magnetic material;

(B) a first magnet disposed in said first plate for movement therewith;

(C) a second hinge plate of non-magnetic material; and (D) a second magnet disposed in said second plate for movement therewith;

said first and second plates being generally juxtaposed and independently pivotable about the hinge axis in respective parallel planes transverse to the hinge axis between:

(i) a closed orientation wherein said first and second plates are essentially superposed, and (ii) an open orientation wherein said first and second plates are essentially not superposed;

said first and second magnets being essentially superposed and in the same magnetic orientation;

said first plate defining a first abutment structure projecting from a surface thereof towards said second plate, and said second plate defining a cooperating first stop structure projecting from a surface thereof towards said first plate;

when said first and second plates are adjacent and in said closed orientation, said first abutment structure impeding relative pivoting of said first plate in a first direction about the hinge axis by lateral abutment thereof with said cooperating first stop structure of said second plate.

2. The hinge of claim 1 wherein said first abutment structure and said cooperating first stop structure are, cooperatively configured and dimensioned to preclude forcible relative pivoting of said plates in said first direction.

3. The hinge of claim 1 wherein the degree of impedance to relative pivoting of said plates is a function of the heights and configurations of said first abutment structure and said cooperating first stop structure.

4. The hinge of claim 1 wherein said first abutment structure and said cooperating first stop structure are cooperatively configured and dimensioned to enable forcible relative pivoting of said plates in said first direction by at least temporarily partially spacing said plates apart such that one of said first abutment structure and said cooperating first stop structure is cammable over the other to enable bypassing thereof.

5. The hinge of claim 4 wherein said first plate also defines a second abutment structure, and said second plate also defines a cooperating second stop structure, said second abutment structure and said cooperating second stop structure being cooperatively configured and dimensioned to preclude forcible relative pivoting of said plates in a second direction opposite said first direction.

6. The hinge of claim 5 wherein said first abutment structure and said cooperating first stop structure enable forcible relative pivoting of said plates in said first direction, and said second abutment structure and said cooperating second stop structure preclude forcible relative pivoting of said plates in said second direction.

7. The hinge of claim 5 wherein said plates are substantially rectangular in plan, said first plate defining at least one of said first abutment structures and at least one of said second abutment structures, and said second plate defining at least one of said cooperating first stop structures and at least one of said cooperating second stop structures, thereby to impede relative movement of said plates in at least one direction about the hinge axis and to preclude relative movement of said plates in at least one direction about the hinge axis.

8. The hinge of claim 7 wherein each of said at least one first and second abutment structures and each of said at least one cooperating first and second stop structures is disposed adjacent a different respective one of the four sides of said rectangular plates.

9. The hinge of claim 7 wherein each of said at least one first and second abutment structures and each of said at least one cooperating first and second stop structures is disposed parallel to a different respective one of the four sides of said rectangular plates.

10. The hinge of claim 7 wherein two of said first abutment structures are opposite one another, two of said second abutment structures are opposite one another, two of said first stop structures are opposite one another, and two of said second stop structures are opposite one another.

11. The hinge of claim 7 wherein said first abutment structures and said cooperating first stop structures are cooperatively configured and dimensioned to enable forcible relative movement of said plates laterally by at least temporarily partially spacing said plates apart such that one of said first abutment structure and said cooperating first stop structure is cammable over the other to enable bypassing thereof, and said second abutment structures and said second stop structures are cooperatively configured and dimensioned to preclude forcible relative movement of said plates longitudinally.

12. The hinge of claim 5 wherein said plates are substantially rectangular in plan, said first plate defining four of said first abutment structures, and said second plate defining four of said cooperating first stop structures, thereby to impede relative movement of said plates in four orthogonal directions.

13. The hinge of claim 12 wherein each of said four first abutment structures and each of said four cooperating first stop structures is disposed adjacent a different respective one of the four sides of said rectangular plates.

14. The hinge of claim 12 wherein each of said four first abutment structures and each of said four cooperating first stop structures is disposed parallel to a different respective one of the four sides of said rectangular plates.

15. The hinge of claim 12 wherein said first abutment structures and said cooperating first stop structures are cooperatively configured and dimensioned to enable forcible relative movement of said plates in four orthogonal directions by at least temporarily partially spacing said plates apart such that one of said first abutment structure and said cooperating first stop structure is cammable over the other to enable bypassing thereof.

16. The hinge of claim 5 wherein said plates are substantially semicircular in plan, said plates together defining:

(i) at least one of said first abutment structures and at least one of said cooperating first stop structures, and (ii) at least one of said second abutment structures and at least one of said cooperating second stop structures.

17. The hinge of claim 16 wherein said one first abutment structure and said one cooperating first stop structure are substantially linear.

18. The hinge of claim 17 wherein said one second abutment structure and said one cooperating second stop structure are substantially arcuate.

19. A magnetic hinge defining a hinge axis, comprising:

(A) a first hinge plate of non-magnetic material;

(B) a first magnet disposed in said first plate for movement therewith;

(C) a second hinge plate of non-magnetic material; and (D) a second magnet disposed in said second plate for movement therewith;

said first and second plates being generally juxtaposed and independently pivotable about the hinge axis in respective parallel planes transverse to the hinge axis between:

(i) a closed orientation wherein said first and second plates are essentially superposed, and (ii) an open orientation wherein said first and second plates are essentially not superposed;

said first and second magnets being essentially superposed and in the same magnetic orientation;

said first plate defining first and second abutment structures projecting from a surface thereof towards said second plate, and said second plate defining cooperating first and second stop structures projecting from a surface thereof towards said first plate;

when said first and second plates are adjacent and in said closed orientation, said first abutment structure precluding relative forcible pivoting of said first plate in a first direction about the hinge axis by lateral abutment thereof with said cooperating first stop structure of said second plate, and said second abutment structure precluding forcible relative pivoting of said first plate in a second direction about the hinge axis opposite said first direction by lateral abutment thereof with said cooperating second stop structure of said second plate.

20. The hinge of claim 19 wherein said first abutment structure and said cooperating first stop structure are cooperatively configured and dimensioned to preclude forcible relative pivoting of said plates in said first direction, and said second abutment structure and said cooperating second stop structure are cooperatively configured and dimensioned to preclude forcible relative pivoting of said plates in said second direction.

21. The hinge of claim 20 wherein said plates are substantially rectangular in plan, said first plate defining at least one of said first abutment structures and at least one of said second abutment structures, and said second plate defining at least one of said cooperating first stop structures and at least one of said cooperating second stop structures, thereby to preclude relative movement of said plates in either of said first and second directions about the hinge axis.

22. The hinge of claim 21 wherein each of said at least one first and second abutment structures and each of said at least one cooperating first and second stop structures is disposed adjacent a different respective one of the four sides of said rectangular plates.

23. The hinge of claim 21 wherein each of said at least one first and second abutment structures and each of said at least one cooperating first and second stop structures is disposed parallel to a different respective one of the four sides of said rectangular plates.

24. The hinge of claim 21 wherein two of said first abutment structures are opposite one another, two of said second abutment structures are opposite one another, two of said first stop structures are opposite one another, and two of said second stop structures are opposite one another.

25. The hinge of claim 19 wherein said plates are substantially rectangular in plan, said first plate defining four of said first abutment structures, and said second plate defining four of said cooperating first stop structures, thereby to preclude relative movement of said plates in four orthogonal directions.

26. The hinge of claim 25 wherein each of said four first abutment structures and each of said four cooperating first stop structures is disposed adjacent a different respective one of the four sides of said rectangular plates.

27. The hinge of claim 25 wherein each of said four first abutment structures and each of said four cooperating first stop structures is disposed parallel to a different respective one of the four sides of said rectangular plates.

* * * * *